US010882064B2

(12) United States Patent
Pellegrino et al.

(10) Patent No.: US 10,882,064 B2
(45) Date of Patent: Jan. 5, 2021

(54) CONVERTIBLE PAINT CUP ASSEMBLY WITH AIR INLET VALVE

(71) Applicants: Biagio P. Pellegrino, Niskayuna, NY (US); Thomas R. Nixon, Au Gres, MI (US); Clemens E. Zoellner, Bay City, MI (US)

(72) Inventors: Biagio P. Pellegrino, Niskayuna, NY (US); Thomas R. Nixon, Au Gres, MI (US); Clemens E. Zoellner, Bay City, MI (US)

(73) Assignee: SAINT-GOBAIN ABRASIVES, INC./SAINT-GOBAIN ABRASIFS, Worcester, MA (US)

( * ) Notice: Subject to any disclaimer, the term of this patent is extended or adjusted under 35 U.S.C. 154(b) by 603 days.

(21) Appl. No.: 13/728,678

(22) Filed: Dec. 27, 2012

(65) Prior Publication Data

US 2013/0168468 A1 Jul. 4, 2013

Related U.S. Application Data

(60) Provisional application No. 61/582,227, filed on Dec. 30, 2011.

(51) Int. Cl.
*B05B 11/00* (2006.01)
*B05B 7/24* (2006.01)
(Continued)

(52) U.S. Cl.
CPC ..... *B05B 11/0054* (2013.01); *B05B 7/24* (2013.01); *B05B 7/2408* (2013.01);
(Continued)

(58) Field of Classification Search
CPC ..... B05B 11/0054; B05B 7/24; B05B 7/2408; B05B 7/2478; B05B 15/061; B05B 15/008; B05B 15/40; B05B 15/62; B65D 85/70
(Continued)

(56) References Cited

U.S. PATENT DOCUMENTS 533,489 A 2/1895 Ogram
758,239 A 4/1904 Ducart
(Continued)

FOREIGN PATENT DOCUMENTS

AU 200032550 B3 7/2000
AU 199935838 A1 1/2001
(Continued)

OTHER PUBLICATIONS

Amended Complaint and Demand for Jury Trial *3M Innovative Properties Company and 3M Company* vs. *Illinois Tool Works, Inc. and ITW Finishing, L.L.C.*, Case No. 06-2459 (U.S. District Court, District of Minnesota) filed Aug. 7, 2006 (5 pgs).
(Continued)

*Primary Examiner* — Arthur O. Hall
*Assistant Examiner* — Steven M Cernoch
(74) *Attorney, Agent, or Firm* — Abel Schillinger, LLP; Joseph Sullivan

(57) ABSTRACT

A paint cup assembly for a paint sprayer is disclosed and includes a cap, a paint reservoir formed with an air inlet port, and a valve assembly disposed within the paint reservoir and engaged with the air inlet, wherein the valve assembly is configured to be operable from a closed configuration, in which air flow through the air inlet port is prevented, and an open configuration, in which air flow through the air inlet port is permitted, upon actuation of a spray gun.

17 Claims, 13 Drawing Sheets

(51) Int. Cl.
*B05B 15/40* (2018.01)
*B05B 15/62* (2018.01)

(52) U.S. Cl.
CPC ..... *B05B 7/2478* (2013.01); *B05B 15/40* (2018.02); *B05B 15/62* (2018.02)

(58) Field of Classification Search
USPC ..... 239/302, 311, 337, 345, 346, 347, 372, 239/373, 375, 376, 377, 379, 323–328
See application file for complete search history.

(56) References Cited

U.S. PATENT DOCUMENTS 1,370,687 A 3/1921 Ferris
1,556,913 A 10/1924 Capra
1,703,384 A 2/1929 Birkenmaier
1,722,101 A 7/1929 Little
1,748,440 A 2/1930 Burdick
1,843,269 A 2/1932 Capser
1,843,899 A 2/1932 Martinet
2,004,574 A 6/1935 Gee, Jr.
2,005,026 A 6/1935 Ellsworth
2,051,518 A 8/1936 Cunningham
D105,960 S 9/1937 Lieberman
2,177,032 A 10/1939 Baumgardner
2,200,675 A 5/1940 Northcutt
2,228,861 A 1/1941 Wegener
2,310,633 A 2/1943 Heimburger
2,318,717 A 5/1943 Rose
2,593,639 A 4/1952 Whitehouse
2,593,839 A 4/1952 Buc
2,595,317 A 5/1952 White
2,606,586 A 8/1952 Hill
2,612,404 A * 9/1952 Andersson ..... 239/345
2,641,365 A 6/1953 Lundeen
2,656,217 A 10/1953 Roche
2,670,239 A 2/1954 Ditch
2,670,882 A 3/1954 Best
2,770,706 A 11/1956 Vogtle et al.
2,795,461 A 6/1957 Durkin
2,851,187 A 9/1958 Hall
2,877,934 A 3/1959 Wallace
2,901,182 A 8/1959 Cragg et al.
2,959,358 A 11/1960 Vork
3,000,576 A 9/1961 Levey et al.
3,035,623 A 5/1962 Goetz
3,066,872 A 12/1962 Kobee
3,134,494 A 5/1964 Quinn
3,136,486 A 6/1964 Docken
3,157,360 A 11/1964 Heard
3,163,544 A 12/1964 Valyi
3,167,210 A 1/1965 Carney, Jr.
3,186,643 A 6/1965 George et al.
3,195,819 A 7/1965 Watanabe
3,198,438 A 8/1965 Hultgren
3,211,324 A 10/1965 Sapien
3,227,305 A 1/1966 Enssle
3,236,459 A * 2/1966 McRitchie ..... 239/416
3,240,398 A 3/1966 Dalton, Jr.
3,255,972 A 6/1966 Hultgren et al.
3,260,464 A 7/1966 Harant
3,335,913 A 8/1967 Bouet
3,338,406 A 8/1967 Anderson
3,362,640 A 1/1968 Fainman
3,381,845 A 5/1968 MacDonald
3,393,842 A 7/1968 Bruce et al.
3,401,842 A 9/1968 Morrison
3,406,853 A 10/1968 McLeod
3,432,104 A 3/1969 Kaltenbach
3,487,989 A 1/1970 Rausing et al.
3,507,309 A 4/1970 Johnson
3,524,589 A * 8/1970 Pelton, Jr. ..... 239/308
3,592,365 A * 7/1971 Schwartzman ..... 222/209
3,593,921 A 7/1971 Boltic
3,606,092 A 9/1971 Kollmai
3,658,122 A 4/1972 Kalyk
3,672,645 A 6/1972 Terrels et al.
3,674,074 A 7/1972 Lavis
3,757,718 A 9/1973 Johnson
3,773,211 A 11/1973 Bridgman
3,776,408 A 12/1973 Wald
3,779,419 A 12/1973 Heitz
3,780,950 A 12/1973 Brennan
3,784,039 A 1/1974 Marco
3,790,017 A 2/1974 Fitzpatrick et al.
3,790,021 A 2/1974 Bailey
3,815,967 A 6/1974 Jocelyn
3,841,555 A 10/1974 Lilja
3,853,157 A 12/1974 Madaio
3,858,810 A 1/1975 Seeley et al.
3,892,360 A 7/1975 Schlottmann et al.
3,934,746 A 1/1976 Lilja
3,937,367 A 2/1976 Hood
3,939,842 A 2/1976 Harris
3,940,052 A 2/1976 McHugh
4,035,004 A 7/1977 Hengesbach
4,043,510 A 8/1977 Morris
4,067,499 A 1/1978 Cohen
4,069,751 A 1/1978 Gronwick et al.
4,088,268 A 5/1978 Vohringer
4,095,720 A 6/1978 Delbrouck et al.
4,122,973 A 10/1978 Ahern
4,140,279 A 2/1979 Hawkins
4,151,929 A 5/1979 Sapien
4,159,081 A 6/1979 Demler et al.
4,186,783 A 2/1980 Brandt
4,193,506 A 3/1980 Trindle et al.
D257,668 S 12/1980 Ahern
4,258,862 A 3/1981 Thorsheim
4,307,820 A 12/1981 Binoche
4,321,922 A 3/1982 Deaton
4,339,046 A * 7/1982 Coen ..... 215/11.5
4,347,948 A 9/1982 Hamada et al.
4,379,455 A 4/1983 Deaton
4,383,635 A 5/1983 Yotoriyama
4,388,044 A 6/1983 Wilkinson
4,401,274 A 8/1983 Coffee
4,403,738 A * 9/1983 Kern ..... 239/313
4,405,088 A 9/1983 Gray
4,406,406 A 9/1983 Knapp
4,411,387 A 10/1983 Stern et al.
4,418,843 A 12/1983 Jackman
4,430,084 A 2/1984 Deaton
4,442,003 A 4/1984 Holt
4,455,140 A 6/1984 Joslin
4,457,455 A 7/1984 Meshberg
4,491,254 A 1/1985 Viets et al.
4,501,500 A 2/1985 Terrels
4,516,693 A 5/1985 Gaston
4,558,792 A 12/1985 Cabernoch et al.
4,559,140 A 12/1985 Croteau
4,562,965 A 1/1986 Ihmels et al.
D283,832 S 5/1986 Weinstein et al.
4,586,628 A 5/1986 Nittel
4,621,770 A 11/1986 Sayen
4,623,095 A 11/1986 Pronk
4,625,890 A 12/1986 Galer
4,628,644 A 12/1986 Somers
4,633,052 A 12/1986 Beavers et al.
4,645,097 A 2/1987 Kaufman
4,653,691 A 3/1987 Grime
4,657,151 A 4/1987 Cabernoch
D290,990 S 7/1987 Izzi
4,693,423 A 9/1987 Roe et al.
4,712,739 A 12/1987 Bihn
4,760,962 A 8/1988 Wheeler
4,781,311 A 11/1988 Dunning et al.
4,811,904 A 3/1989 Ihmels et al.
4,813,556 A 3/1989 Lawrence
4,813,609 A 3/1989 French
D300,555 S 4/1989 Patterson
4,818,589 A 4/1989 Johnson et al.
4,824,018 A 4/1989 Shreve
4,836,764 A 6/1989 Parkinson

(56) References Cited

U.S. PATENT DOCUMENTS 4,842,165 A * 6/1989 Van Coney ..... 222/95
4,909,409 A 3/1990 Shreve
4,925,055 A 5/1990 Robbins, III et al.
4,930,644 A 6/1990 Robbins, III
4,936,511 A 6/1990 Johnson et al.
D309,858 S 8/1990 Meyersburg
4,946,558 A 8/1990 Salmon
4,951,875 A 8/1990 Devey
4,961,537 A 10/1990 Stern
4,962,885 A 10/1990 Coffee
4,971,251 A 11/1990 Dobrick et al.
4,979,628 A 12/1990 Robbins, III
4,982,868 A 1/1991 Robbins, III
4,998,696 A 3/1991 Desjardins
4,999,109 A 3/1991 Sabre
5,005,726 A 4/1991 Robbins
5,035,339 A 7/1991 Meyersburg
5,052,623 A 10/1991 Nordeen
5,054,687 A 10/1991 Burns et al.
5,059,319 A 10/1991 Welsh
5,060,816 A 10/1991 Robbins, III
5,069,389 A 12/1991 Bitsakos
5,071,070 A 12/1991 Hardy
5,078,322 A 1/1992 Torntore
5,078,323 A 1/1992 Frank
5,094,543 A 3/1992 Mursa
5,102,052 A 4/1992 Demarest et al.
5,102,384 A 4/1992 Ross et al.
5,118,003 A 6/1992 Pepper et al.
5,119,992 A 6/1992 Grime
5,123,571 A 6/1992 Rebeyrolle et al.
5,143,242 A 9/1992 Millasich
5,143,294 A 9/1992 Lintvedt
5,186,828 A 2/1993 Mankin
5,209,365 A 5/1993 Wood
5,209,501 A 5/1993 Smith
5,236,128 A 8/1993 Morita et al.
5,236,506 A 8/1993 Mazakas
5,238,150 A 8/1993 Williams
5,248,089 A 9/1993 Bekius
5,248,096 A 9/1993 Hoey et al.
5,253,900 A 10/1993 Snyder
D341,189 S 11/1993 Legassie et al.
5,259,400 A 11/1993 Bruno et al.
5,261,751 A 11/1993 Heinz
5,267,693 A 12/1993 Dickey
5,269,840 A 12/1993 Morris et al.
5,295,606 A 3/1994 Karwoski
5,308,647 A 5/1994 Lappi
5,326,001 A 7/1994 Holmquist et al.
5,328,095 A 7/1994 Wickenhaver
5,332,158 A 7/1994 Styne et al.
5,337,921 A 8/1994 Wilson et al.
5,341,836 A 8/1994 Doherty
5,358,402 A 10/1994 Reed et al.
5,368,395 A 11/1994 Crimmins
5,377,852 A 1/1995 Demorest
5,381,918 A 1/1995 Dahl
5,385,251 A 1/1995 Dunn
5,400,573 A 3/1995 Crystal et al.
5,405,090 A 4/1995 Greene et al.
5,415,352 A 5/1995 May
5,421,489 A 6/1995 Holzner, Sr. et al.
5,424,086 A 6/1995 Walker
5,454,488 A 10/1995 Geier
5,460,289 A 10/1995 Gemmell
5,462,711 A 10/1995 Ricottone
5,468,383 A 11/1995 McKenzie
5,492,242 A 2/1996 Gall
5,501,397 A 3/1996 Holt
5,569,377 A 10/1996 Hashimoto
5,582,350 A * 12/1996 Kosmyna et al. ..... 239/345
5,607,082 A 3/1997 Cracauer
5,617,972 A 4/1997 Morano et al.
5,631,055 A 5/1997 Vines et al.
5,655,714 A 8/1997 Kieffer et al.
5,667,858 A 9/1997 Pokorny
D386,654 S 11/1997 Kosmyna
5,695,837 A 12/1997 Everaerts et al.
5,713,519 A 2/1998 Sandison et al.
5,789,684 A 8/1998 Masek et al.
5,797,520 A 8/1998 Donahue
5,803,302 A 9/1998 Sato et al.
5,803,360 A 9/1998 Spitznagel
5,803,367 A 9/1998 Heard et al.
5,806,711 A 9/1998 Morano et al.
5,816,431 A 10/1998 Giannopoulos
5,816,501 A 10/1998 LoPresti et al.
5,826,795 A 10/1998 Holland et al.
5,829,588 A 11/1998 Bloomfield
5,853,102 A 12/1998 Jarrett
5,863,431 A 1/1999 Salzburg
5,878,899 A 3/1999 Manganiello et al.
5,921,426 A 7/1999 Randolph
5,938,016 A 8/1999 Erdtmann
5,954,273 A 9/1999 Ruta et al.
5,964,365 A 10/1999 Peeples et al.
5,967,379 A 10/1999 Crossdale et al.
5,996,427 A 12/1999 Masek et al.
6,019,294 A 2/2000 Anderson et al.
6,027,041 A 2/2000 Evans
6,053,429 A 4/2000 Chang
6,092,740 A 7/2000 Liu
D431,279 S 9/2000 Spriegel
6,196,410 B1 3/2001 Hocking
6,257,429 B1 7/2001 Kong
6,264,115 B1 7/2001 Liska et al.
6,277,478 B1 8/2001 Kurita et al.
6,287,669 B1 9/2001 George et al.
D449,381 S 10/2001 de Begon de Larouziere
6,302,445 B1 10/2001 Kugele et al.
6,371,385 B1 4/2002 Schiller et al.
6,390,386 B2 5/2002 Krohn et al.
6,394,152 B1 5/2002 Martin
D460,825 S 7/2002 Renz
6,435,426 B1 8/2002 Copp, Jr.
D462,268 S 9/2002 Schroeder et al.
6,455,140 B1 9/2002 Whitney et al.
6,475,609 B1 11/2002 Whitney et al.
6,536,684 B1 3/2003 Wei
6,536,687 B1 3/2003 Navis et al.
6,588,681 B2 7/2003 Rothrum et al.
6,595,441 B2 7/2003 Petrie et al.
6,663,018 B2 12/2003 Rothrum et al.
6,698,670 B1 3/2004 Gosis et al.
6,712,292 B1 3/2004 Gosis et al.
6,717,673 B1 4/2004 Janssen et al.
6,749,132 B2 6/2004 Pettit et al.
6,752,179 B1 6/2004 Schwartz
6,796,514 B1 9/2004 Schwartz
6,820,824 B1 11/2004 Joseph et al.
6,877,677 B2 4/2005 Schmon et al.
6,899,239 B1 5/2005 Gray
6,938,836 B2 9/2005 Bouic
6,942,126 B2 9/2005 Douglas et al.
6,945,429 B2 9/2005 Gosis et al.
6,946,122 B2 9/2005 Yang
6,953,155 B2 10/2005 Joseph et al.
6,958,033 B1 10/2005 Malin
6,982,108 B2 1/2006 Janssen et al.
7,014,127 B2 3/2006 Valpey, III et al.
7,083,119 B2 8/2006 Bouic et al.
7,086,549 B2 8/2006 Kosmyna et al.
7,128,102 B2 10/2006 Pendleton et al.
7,143,960 B2 12/2006 Joseph et al.
7,159,734 B1 1/2007 O'Brien
7,165,732 B2 1/2007 Kosmyna et al.
7,172,139 B2 2/2007 Bouic et al.
7,175,110 B2 * 2/2007 Vicentini ..... 239/526
7,188,785 B2 3/2007 Joseph et al.
7,269,969 B2 9/2007 Strickland et al.
7,296,759 B2 11/2007 Alexander et al.
7,344,040 B2 3/2008 Kosmyna et al.
7,350,723 B2 * 4/2008 Reedy ..... 239/332

(56) References Cited

U.S. PATENT DOCUMENTS

| | | | | |
|---|---|---|---|---|
| 7,353,964 | B2 | 4/2008 | Kosmyna | |
| 7,354,074 | B2 | 4/2008 | Kosmyna et al. | |
| 7,374,111 | B2 | 5/2008 | Joseph et al. | |
| 7,380,680 | B2 | 6/2008 | Kosmyna et al. | |
| 7,451,884 | B2 * | 11/2008 | Kuehn et al. | 215/12.2 |
| D582,512 | S | 12/2008 | Fontaine | |
| D586,059 | S | 2/2009 | Bechtold, Jr. | |
| 7,568,638 | B2 | 8/2009 | Gehrung | |
| 7,625,016 | B2 | 12/2009 | Kosmyna et al. | |
| 7,694,896 | B2 * | 4/2010 | Turnbull et al. | 239/379 |
| D615,161 | S | 5/2010 | Gerson et al. | |
| 7,757,972 | B2 | 7/2010 | Kosmyna et al. | |
| 7,798,421 | B2 | 9/2010 | Joseph et al. | |
| 7,798,425 | B2 | 9/2010 | Joseph et al. | |
| 7,798,426 | B2 | 9/2010 | Joseph et al. | |
| 7,798,427 | B2 | 9/2010 | Joseph et al. | |
| 7,802,763 | B2 | 9/2010 | Faller et al. | |
| 7,810,744 | B2 * | 10/2010 | Schmon et al. | 239/321 |
| 7,819,263 | B1 | 10/2010 | DiCarlo-Nelson | |
| 7,819,341 | B2 * | 10/2010 | Schmon et al. | 239/321 |
| 7,823,806 | B2 | 11/2010 | Schmon | |
| 7,878,425 | B2 | 2/2011 | Handzel et al. | |
| 7,921,583 | B2 | 4/2011 | Londino | |
| 8,002,200 | B2 | 8/2011 | Joseph et al. | |
| 8,033,413 | B2 | 10/2011 | Gerson et al. | |
| 8,052,071 | B2 | 11/2011 | Kruse | |
| 8,127,963 | B2 | 3/2012 | Gerson et al. | |
| 8,201,709 | B1 | 6/2012 | Namigata et al. | |
| 8,230,997 | B1 | 7/2012 | McWilliams et al. | |
| 8,272,255 | B2 | 9/2012 | Halverson et al. | |
| 8,297,536 | B2 * | 10/2012 | Ruda | 239/345 |
| 8,444,067 | B2 | 5/2013 | Schmon et al. | |
| 8,544,669 | B2 * | 10/2013 | Escoto et al. | 220/23.91 |
| 8,944,351 | B2 * | 2/2015 | Pellegrino et al. | 239/569 |
| 8,960,502 | B2 * | 2/2015 | Stehli et al. | 222/386.5 |
| 2002/0014541 | A1 | 2/2002 | Krohn et al. | |
| 2002/0121139 | A1 | 9/2002 | Purpura et al. | |
| 2003/0003301 | A1 | 1/2003 | Whitney et al. | |
| 2003/0008144 | A1 | 1/2003 | Whitney et al. | |
| 2003/0209573 | A1 | 11/2003 | Bouic | |
| 2004/0016825 | A1 | 1/2004 | Petrie et al. | |
| 2004/0067350 | A1 | 4/2004 | Janssen et al. | |
| 2004/0084553 | A1 | 5/2004 | Joseph et al. | |
| 2004/0118941 | A1 | 6/2004 | Joseph et al. | |
| 2004/0140373 | A1 | 7/2004 | Joseph et al. | |
| 2004/0164182 | A1 | 8/2004 | Joseph et al. | |
| 2004/0217201 | A1 | 11/2004 | Ruda | |
| 2004/0232714 | A1 | 11/2004 | Coppotelli et al. | |
| 2004/0256484 | A1 | 12/2004 | Joseph et al. | |
| 2004/0256485 | A1 | 12/2004 | P. Joseph et al. | |
| 2005/0029285 | A1 | 2/2005 | Gay, III et al. | |
| 2005/0045146 | A1 | 3/2005 | McKay et al. | |
| 2005/0067502 | A1 | 3/2005 | Bouic et al. | |
| 2005/0092770 | A1 | 5/2005 | Yechouron | |
| 2005/0145718 | A1 | 7/2005 | Blette et al. | |
| 2005/0145723 | A1 | 7/2005 | Blette et al. | |
| 2005/0145724 | A1 | 7/2005 | Blette et al. | |
| 2005/0156058 | A1 | 7/2005 | Kosmyna et al. | |
| 2005/0241722 | A1 | 11/2005 | Pendleton et al. | |
| 2005/0242107 | A1 | 11/2005 | Kosmyna et al. | |
| 2005/0258271 | A1 | 11/2005 | Kosmyna et al. | |
| 2005/0263614 | A1 | 12/2005 | Kosmyna et al. | |
| 2005/0279748 | A1 | 12/2005 | Kosmyna | |
| 2006/0000927 | A1 | 1/2006 | Ruda | |
| 2006/0017286 | A1 | 1/2006 | Kosmyna et al. | |
| 2006/0043217 | A1 | 3/2006 | Kosmyna et al. | |
| 2006/0065591 | A1 | 3/2006 | Joseph | |
| 2006/0102550 | A1 | 5/2006 | Joseph et al. | |
| 2006/0144960 | A1 | 7/2006 | Kosmyna et al. | |
| 2006/0151630 | A1 | 7/2006 | Joseph et al. | |
| 2006/0157594 | A1 | 7/2006 | Cooke | |
| 2006/0175433 | A1 | 8/2006 | Escoto, Jr. et al. | |
| 2006/0196891 | A1 | 9/2006 | Gerson et al. | |
| 2006/0273204 | A1 | 12/2006 | Joseph et al. | |
| 2006/0283861 | A1 | 12/2006 | Kosmyna et al. | |
| 2007/0131793 | A1 | 6/2007 | Joseph et al. | |
| 2007/0158348 | A1 | 7/2007 | Kosmyna et al. | |
| 2007/0158349 | A1 * | 7/2007 | Schmon et al. | 220/221 |
| 2007/0252019 | A1 | 11/2007 | Peterson et al. | |
| 2007/0272323 | A1 | 11/2007 | Verhaeghe | |
| 2008/0011879 | A1 | 1/2008 | Gerson et al. | |
| 2008/0054087 | A1 | 3/2008 | Joseph et al. | |
| 2008/0118656 | A1 | 5/2008 | Douglas et al. | |
| 2009/0072050 | A1 | 3/2009 | Ruda | |
| 2009/0110861 | A1 | 4/2009 | Sherman | |
| 2009/0145980 | A1 | 6/2009 | Jones | |
| 2009/0166443 | A1 | 7/2009 | Joseph et al. | |
| 2009/0183565 | A1 | 7/2009 | Shamoon et al. | |
| 2009/0193880 | A1 | 8/2009 | Halverson et al. | |
| 2009/0200309 | A1 | 8/2009 | Kosmyna et al. | |
| 2010/0108783 | A1 | 5/2010 | Joseph et al. | |
| 2010/0139858 | A1 | 6/2010 | Douglas et al. | |
| 2010/0163645 | A1 | 7/2010 | Johnson et al. | |
| 2010/0243758 | A1 | 9/2010 | Juo | |
| 2010/0288772 | A1 | 11/2010 | Wambeke et al. | |
| 2011/0220737 | A1 | 9/2011 | Kwon | |
| 2011/0266368 | A1 | 11/2011 | Joseph et al. | |
| 2012/0037529 | A1 | 2/2012 | Hall | |
| 2012/0256010 | A1 | 10/2012 | Joseph et al. | |
| 2012/0273583 | A1 | 11/2012 | Gerson et al. | |
| 2012/0279609 | A1 | 11/2012 | Pellegrino et al. | |
| 2012/0279613 | A1 | 11/2012 | Pellegrino et al. | |
| 2012/0279887 | A1 | 11/2012 | Pellegrino et al. | |
| 2012/0279970 | A1 | 11/2012 | Pellegrino et al. | |
| 2012/0280062 | A1 | 11/2012 | Pellegrino et al. | |
| 2012/0280063 | A1 | 11/2012 | Pellegrino et al. | |
| 2013/0001322 | A1 | 1/2013 | Pellegrino et al. | |

FOREIGN PATENT DOCUMENTS

| | | | |
|---|---|---|---|
| AU | 2004/202537 | A1 | 1/2005 |
| CA | 963436 | | 2/1975 |
| CA | 965388 | | 4/1975 |
| CA | 1006450 | | 3/1977 |
| CA | 1192852 | A | 9/1985 |
| CA | 2099763 | A1 | 7/1992 |
| CA | 2569369 | A1 | 7/1998 |
| CA | 2660187 | A1 | 7/1998 |
| CA | 2595507 | A1 | 6/2006 |
| CA | 2277096 | C | 4/2007 |
| CH | 540159 | A | 8/1973 |
| CH | 688082 | A | 5/1997 |
| CN | 1142830 | C | 3/2004 |
| DE | 534273 | C | 9/1931 |
| DE | 2412743 | A1 | 9/1975 |
| DE | 2900998 | A1 | 7/1980 |
| DE | 3020831 | A1 | 12/1981 |
| DE | 8304005 | U1 | 6/1983 |
| DE | 3439442 | A1 | 4/1986 |
| DE | 3517122 | C1 | 5/1986 |
| DE | 3507734 | A1 | 9/1986 |
| DE | 3346165 | C2 | 4/1987 |
| DE | G 8807118 | U1 | 9/1988 |
| DE | 4002190 | A1 | 8/1991 |
| DE | 4102326 | A1 | 7/1992 |
| DE | 4209258 | A1 | 9/1993 |
| DE | 19618514 | A1 | 11/1997 |
| DE | 29905100 | U1 | 6/1999 |
| DE | 20117496 | U1 | 1/2002 |
| DE | 29825015 | U1 | 3/2004 |
| DE | 29825119 | U1 | 1/2005 |
| DE | 29825120 | U1 | 2/2005 |
| DE | 98901823 | T1 | 3/2005 |
| DE | 202004003116 | U | 7/2005 |
| DE | 202004003376 | U | 7/2005 |
| DE | 202004006907 | U1 | 10/2005 |
| DE | 69831653 | T2 | 9/2006 |
| DE | 69836570 | T2 | 9/2007 |
| EP | 0092359 | A2 | 10/1983 |
| EP | 0202124 | A2 | 11/1986 |
| EP | 0230364 | A2 | 7/1987 |
| EP | 0345607 | A1 | 12/1989 |
| EP | 0388199 | A2 | 9/1990 |
| EP | 0388696 | A1 | 9/1990 |

(56) References Cited

FOREIGN PATENT DOCUMENTS

| | | | |
|---|---|---|---|
| EP | 0467334 | A2 | 1/1992 |
| EP | 0345607 | B1 | 9/1992 |
| EP | 0230364 | B2 | 9/1994 |
| EP | 0624353 | A2 | 11/1994 |
| EP | 0634224 | A1 | 1/1995 |
| EP | 0636548 | A1 | 2/1995 |
| EP | 0678334 | A2 | 10/1995 |
| EP | 0689825 | A1 | 1/1996 |
| EP | 0636548 | B1 | 2/1997 |
| EP | 0536344 | B1 | 10/1997 |
| EP | 0847809 | A1 | 6/1998 |
| EP | 0740692 | B1 | 12/1998 |
| EP | 0624353 | B1 | 2/1999 |
| EP | 0987060 | A1 | 3/2000 |
| EP | 1123957 | A1 | 8/2001 |
| EP | 1047732 | B1 | 9/2002 |
| EP | 1366823 | A1 | 3/2003 |
| EP | 1139841 | B1 | 5/2003 |
| EP | 1047731 | B1 | 6/2003 |
| EP | 1210181 | B1 | 10/2003 |
| EP | 1415719 | A1 | 5/2004 |
| EP | 1424135 | A1 | 6/2004 |
| EP | 1435265 | A2 | 7/2004 |
| EP | 1368129 | B1 | 6/2005 |
| EP | 1566223 | A2 | 8/2005 |
| EP | 1579922 | A1 | 9/2005 |
| EP | 1611960 | A1 | 1/2006 |
| EP | 1415719 | B1 | 11/2006 |
| EP | 000638176-0001 | | 1/2007 |
| EP | 1961488 | A2 | 8/2008 |
| EP | 2090372 | A2 | 8/2009 |
| EP | 2090373 | A2 | 8/2009 |
| EP | 2105208 | A2 | 9/2009 |
| EP | 1435265 | B1 | 11/2009 |
| EP | 2221112 | A2 | 8/2010 |
| EP | 1385632 | B1 | 3/2011 |
| EP | 2090372 | A3 | 11/2011 |
| EP | 2090373 | A3 | 11/2011 |
| EP | 2105208 | A3 | 11/2011 |
| FR | 1282085 | | 1/1962 |
| FR | 2631254 | A1 | 11/1989 |
| FR | 2639324 | A1 | 5/1990 |
| FR | 2798868 | A1 | 3/2001 |
| GB | 202363 | A | 8/1923 |
| GB | 256179 | A | 6/1927 |
| GB | 290866 | A | 5/1928 |
| GB | 843161 | A | 8/1960 |
| GB | 1077369 | A | 7/1967 |
| GB | 1567685 | | 5/1980 |
| GB | 2103173 | A | 2/1983 |
| GB | 2170471 | A | 8/1986 |
| GB | 2239821 | A | 7/1991 |
| GB | 2303087 | A | 2/1997 |
| JP | 52113870 | | 9/1977 |
| JP | 64-27659 | | 1/1989 |
| JP | JUM3-81879 | U | 8/1991 |
| JP | JUM 05-39671 | U | 5/1993 |
| JP | 6-328014 | A | 11/1994 |
| JP | 6-335643 | A | 12/1994 |
| JP | 7-289956 | A | 11/1995 |
| JP | A 08-133338 | | 5/1996 |
| JP | JUM 3027372 | | 5/1996 |
| JP | 8-192851 | A | 7/1996 |
| JP | 10007170 | A | 1/1998 |
| JP | 11-028394 | A | 2/1999 |
| JP | 2001508698 | A | 7/2001 |
| JP | 2001-252599 | A | 9/2001 |
| JP | 2007-130521 | | 5/2007 |
| JP | 2008-036561 | A | 2/2008 |
| JP | 2008036561 | A | 2/2008 |
| KR | 10-2007-0023711 | A | 2/2007 |
| KR | 10-2010-0052366 | A | 5/2010 |
| WO | 90-015758 | | 12/1990 |
| WO | 90-15758 | A1 | 12/1990 |
| WO | 1992006794 | A1 | 4/1992 |
| WO | 92/11930 | A1 | 7/1992 |
| WO | 92/14437 | A1 | 9/1992 |
| WO | 92/19386 | A1 | 11/1992 |
| WO | 1994003337 | A2 | 2/1994 |
| WO | 1994008730 | A1 | 4/1994 |
| WO | 95/07762 | A1 | 3/1995 |
| WO | 95/11170 | A1 | 4/1995 |
| WO | 1995019402 | A1 | 7/1995 |
| WO | 98/00796 | A2 | 1/1998 |
| WO | 98/32539 | A1 | 7/1998 |
| WO | 99/06301 | A1 | 2/1999 |
| WO | 1999036477 | A1 | 7/1999 |
| WO | 1999036478 | A1 | 7/1999 |
| WO | 1999040580 | A1 | 8/1999 |
| WO | 99/50153 | A1 | 10/1999 |
| WO | 00/30844 | A1 | 6/2000 |
| WO | 00/38562 | A1 | 7/2000 |
| WO | 2001014766 | A1 | 3/2001 |
| WO | 2002072276 | A1 | 9/2002 |
| WO | 02/085533 | A1 | 10/2002 |
| WO | 03/006170 | A2 | 1/2003 |
| WO | 03/045575 | A1 | 6/2003 |
| WO | 2003095101 | A1 | 11/2003 |
| WO | 2004030938 | A1 | 4/2004 |
| WO | 2004030939 | A1 | 4/2004 |
| WO | 2004/037432 | A1 | 5/2004 |
| WO | 2004/037433 | A1 | 5/2004 |
| WO | 2004/060574 | A1 | 7/2004 |
| WO | 2004/060575 | A1 | 7/2004 |
| WO | 2004/082848 | A1 | 9/2004 |
| WO | 2004/094072 | A1 | 11/2004 |
| WO | 2005/077543 | A1 | 8/2005 |
| WO | 2005/115631 | A1 | 12/2005 |
| WO | 2005/118151 | A1 | 12/2005 |
| WO | 2005/120178 | A2 | 12/2005 |
| WO | 2005/120718 | A1 | 12/2005 |
| WO | 2006/002497 | A1 | 1/2006 |
| WO | 2006/065850 | A1 | 6/2006 |
| WO | 2006069015 | A1 | 6/2006 |
| WO | 2006098799 | A3 | 9/2006 |
| WO | 2007/037921 | A1 | 4/2007 |
| WO | 2007075724 | A2 | 7/2007 |
| WO | 2006098799 | A9 | 9/2007 |
| WO | 2007/149760 | A2 | 12/2007 |
| WO | 2007/149760 | A3 | 12/2007 |
| WO | 2008022027 | A2 | 2/2008 |
| WO | 2008060939 | A1 | 5/2008 |
| WO | 2008109733 | A1 | 9/2008 |
| WO | 2008154559 | A1 | 12/2008 |
| WO | 2009058466 | A1 | 5/2009 |
| WO | 2009/076150 | A2 | 6/2009 |
| WO | 2009/076150 | A3 | 6/2009 |
| WO | 2009120547 | A2 | 10/2009 |
| WO | 2012/068316 | A2 | 5/2012 |
| WO | 2012/154619 | A2 | 11/2012 |
| WO | 2012/154621 | A2 | 11/2012 |
| WO | 2012/154622 | A2 | 11/2012 |
| WO | 2012/154623 | A2 | 11/2012 |
| WO | 2012/154624 | A2 | 11/2012 |
| WO | 2012/154625 | A2 | 11/2012 |
| WO | 2013/003592 | A2 | 1/2013 |
| WO | 2013/101946 | A1 | 7/2013 |

OTHER PUBLICATIONS

Answer and Counter-Claim to amended Complaint, *3M Innovative Properties Company and 3M Company* vs. *Illinois Tool Works, Inc. and ITW Finishing, L.L.C.*, Case No. 06-2459 (U.S. District Court, District of Minnesota) filed Aug. 21, 2006 (8 pgs).

Answer of Defendants Demand for Jury Trial, *3M Innovative Properties Company and 3M Company* vs. *Louis M.Gerson Co., Inc., and Gerson Professional Products, Inc.*, Civil No. 08-04960 JRT-FLN (U.S. District Court, District of Minnesota), filed Oct. 15, 2008 (4 pages).

Complaint and Demand for Jury Trial, *3M Innovative Properties Company and 3M Company* vs. *Illinois Tool Works, Inc. and ITW DeVilbiss*, Case No. 06-2459 (U.S. District Court, District of Minnesota), filed Jun. 16, 2006 (29 pgs).

(56) References Cited

OTHER PUBLICATIONS

Complaint and Demand for Jury Trial, *3M Innovative Properties Company and 3M Company* vs. *Louis M. Gerson Co, Inc., and Gerson Professional Products, Inc.*, Civil No. 08-04960 JRT-FLN (U.S. District Court, District of Minnesota), filed Aug. 19, 2008 (30 pages).
Defendants' Claim Chart, *3M Innovative Properties Company and 3M Company* vs. *Louis M. Gerson Co., Inc., and Gerson Professional Products, Inc.*, Civil No. 08-04960 JRT-FLN (U.S. District Court, District of Minnesota), filed Mar. 2, 2009 (140 pages).
Defendants' Identification of Claim Terms, Phrases or Clauses That May Require Court Construction, *3M Innovative Properties Company and 3M Company* vs. *Louis M. Gerson Co., Inc., and Gerson Professional Products, Inc.*, Civil No. 08-04960 JRT-FLN (U.S. District Court, District of Minnesota), filed Apr. 6, 2009 (3 pages).
Defendant's Prior Art Statement, *3M Innovative Properties Company and 3M Company* vs. *Illinois Tool Works, Inc. and ITW Finishing LLC*, Case No. 06-2459 [U.S. District Court, District of Minnesota] filed Apr. 2, 2007 [12 pages].
Defendants' Prior Art Statement, *3M Innovative Properties Company and 3M Company* vs. *Louis M. Gerson Co., Inc., and Gerson Professional Products, Inc.*, Civil No. 08-04960 JRT-FLN (U.S. District Court, District of Minnesota), filed Mar. 2, 2009 (46 pages).
DeVilbiss PT-500, 510 and 520 2 1/2 Gallon Pressure Tank service bulletin—SB-21-041-B., 6 pages.
DeVilbiss Products PT-500, 510 and 520 2 1/2 Gallon Pressure Tank, Oct. 1998, 7 pages.
DeVilbiss Industrial Distributor Net Price List Spray Equipment, DDP-104, Supplement 1, Oct. 1, 1988, 3 pages.
Falkman, M.A. Plastic Discs Scrap Waste for Disposable Containers. Packaging Digest, Jun. 1996, 2 pages.
Louis M. Gerson Co., Inc. and Gerson Professional Products, Inc. Answers to 3M's First Set of Interrogatories to Gerson (Nos. 1-22), *3M Innovative Properties Company and 3M Company* vs. *Louis M. Gerson Co., Inc., and Gerson Professional Products, Inc.*, Civil No. 08-04960 JRT-FLN (U.S. District Court, District of Minnesota), filed Dec. 11, 2008 (14 pages).
Notice of Opposition and Grounds of Opposition to European Patent No. EP 0954381, *Illinois Tool Works, Inc.* vs. *3M Company*, dated Jun. 19, 2006, 21 pages.
Plaintiffs' Claim Chart, *3M Innovative Properties Company and 3M Company* vs. *Louis M. Gerson Co., Inc., and Gerson Professional Products, Inc.*, Civil No. 08-04960 JRT-FLN (U.S. District Court, District of Minnesota), filed Feb. 2, 2009 (52 pages).
Plaintiffs' Prior Art Statement, *3M Innovative Properties Company and 3M Company* vs. *Louis M. Gerson Co., Inc., and Gerson Professional Products, Inc.*, Civil No. 08-04960 JRT-FLN (U.S. District Court, District of Minnesota), filed Apr. 1, 2009 (25 pages).
SATA Jet 90, Operating Instructions, SATA-Fabspritztechnik GmH & Co., 6 pages.
SATA GmbH & Co. KG, "SATA RPS—The cup system for mixing and painting", K-126995/4022-063, 4 pages.
Service Bulletin, SB-4-043-D, Replaces SB-4-043-C, De Vilbiss, "120175 (GFC-502) 32 OZ. Aluminum Gravity Feed Cup with Disposable Lid and Cup Liner", May, 2000.
Service Bulletin; SB-21-041-B, replaces SB-21-041-A, PT-500, 510, and 520 2 1/2 Gallon Pressure Tank, Oct. 1987 product literature, 6 pages.
International Search Report for PCT Application No. PCT/US05/45146 dated Apr. 21, 2006.
International Search Report for PCT Application No. PCT/US11/61091 dated May 11, 2012.
International Search Report for PCT Application No. PCT/US12/36680 dated Nov. 16, 2012.
International Search Report for PCT Application No. PCT/US12/36684 dated Nov. 23, 2012.
International Search Report for PCT Application No. PCT/US12/36682 dated Nov. 23, 2012.
International Search Report for PCT Application No. PCT/US12/36685 dated Nov. 23, 2012.
International Search Report for PCT Application No. PCT/US12/36686 dated Nov. 23, 2012.
International Search Report for PCT Application No. PCT/US12/36687 dated Nov. 30, 2012.
Inter Partes Reexamination of U.S. Pat. No. 7,374,111 filed Dec. 9, 2008, issued Reexamination No. 95/000,422, 86 pages.
International Search Report for PCT Application No. PCT/US12/44648 dated Jan. 24, 2013.
U.S. Appl. No. 13/728,678, filed Dec. 27, 2012, entitled "Convertible Paint Cup Assembly with Air Inlet Valve".
International Search Report for PCT Application No. PCT/US2012/071843 dated Apr. 29, 2013.

* cited by examiner

CONVERTIBLE PAINT CUP ASSEMBLY WITH AIR INLET VALVE

CROSS-REFERENCE TO RELATED APPLICATION(S)

The present application claims priority from U.S. Provisional Patent Application No. 61/582,227, filed Dec. 30, 2011, entitled "CONVERTIBLE PAINT CUP ASSEMBLY WITH AIR INLET VALVE," naming inventors Biagio P. Pellegrino, Thomas R. Nixon and Clemens E. Zoellner, which application is incorporated by reference herein in its entirety.

FIELD OF THE DISCLOSURE

The present disclosure is directed to a convertible paint cup assembly and to a paint cup assembly having a pressure relief air inlet.

BACKGROUND

Spray guns can be used for rapidly coating surfaces with liquids, such as paint. Paint can be contained in a container that attaches to the spray gun. The outlet of the container can be a releasably connectable coupling that connects to the spray gun. Paint can flow from the container into the spray gun and then, fed to a spray nozzle. The spray nozzle can combine the paint with air, atomize the liquid, and form a spray. At the end of the spraying operation, the container and the mating connection to the spray gun should be thoroughly cleaned so that the paint from one operation does not contaminate the paint to be sprayed in the next spraying operation. Additionally, the coupling between container and spray gun should be free of any dried liquid that might interfere with the connection between container and spray gun. A container with a lid and a disposable cup or liner can be to eliminate or reduce the labor required to clean the container and the coupling to the spray gun.

BRIEF DESCRIPTION OF THE DRAWINGS

Embodiments are illustrated by way of example and are not limited in the accompanying figures.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention. The use of the same reference symbols in different drawings indicates similar or identical items.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or other features that are inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the embodiments of the disclosure. This description should be read to include one or at least one and the singular also includes the plural, or vice versa, unless it is clear that it is meant otherwise.

Unless otherwise defined, all technical and scientific terms used herein have the same meaning as commonly understood by one of ordinary skill in the art to which this disclosure belongs. The materials, methods, and examples are illustrative only and not intended to be limiting. To the extent not described herein, many details regarding specific materials and processing acts are conventional and may be found in textbooks and other sources within the scintillation and radiation detection arts.

Figure 1:
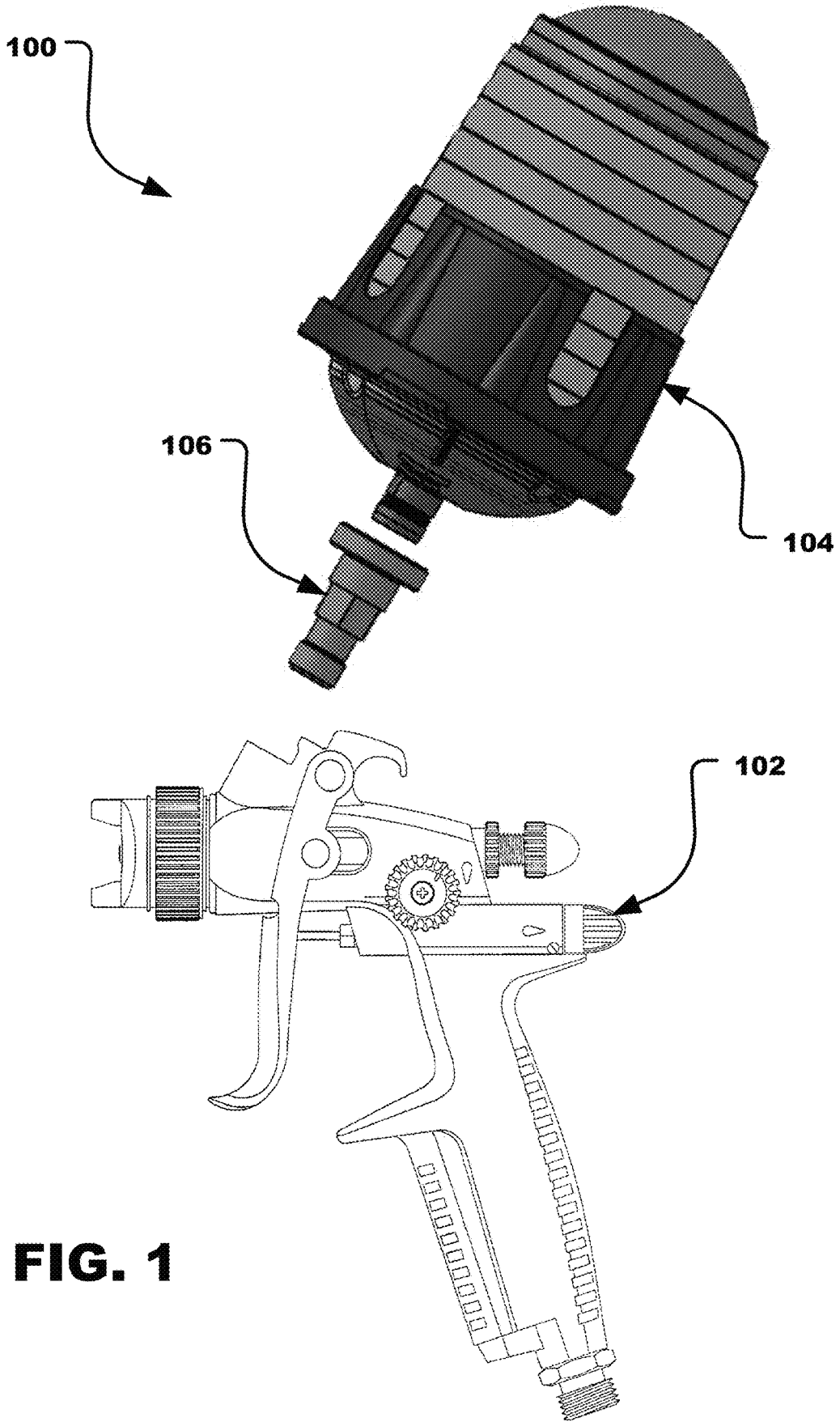
FIG. 1 includes a plan view of a paint sprayer assembly in accordance with a particular embodiment.

Referring initially to FIG. 1, a paint sprayer assembly is illustrated and is generally designated 100. As illustrated, the paint sprayer assembly 100 includes a paint spray gun 102 and a paint cup assembly 104 that can be removably engaged with the paint spray gun 102 via an adapter 106. In a particular aspect, the adapter 106 may be threadably engaged with the paint spray gun 102 and the paint cup assembly 104 may be inserted into the adapter 104. Further, during operation of the paint spray gun 102, the paint cup assembly 104 may be in fluid communication with the paint spray gun 102. Specifically, the paint cup assembly 104 may deliver paint to the paint spray gun 102 and the paint spray gun 102 may be used to transmit the fluid, e.g., paint, to a substrate, e.g., a car body.

Figure 2:
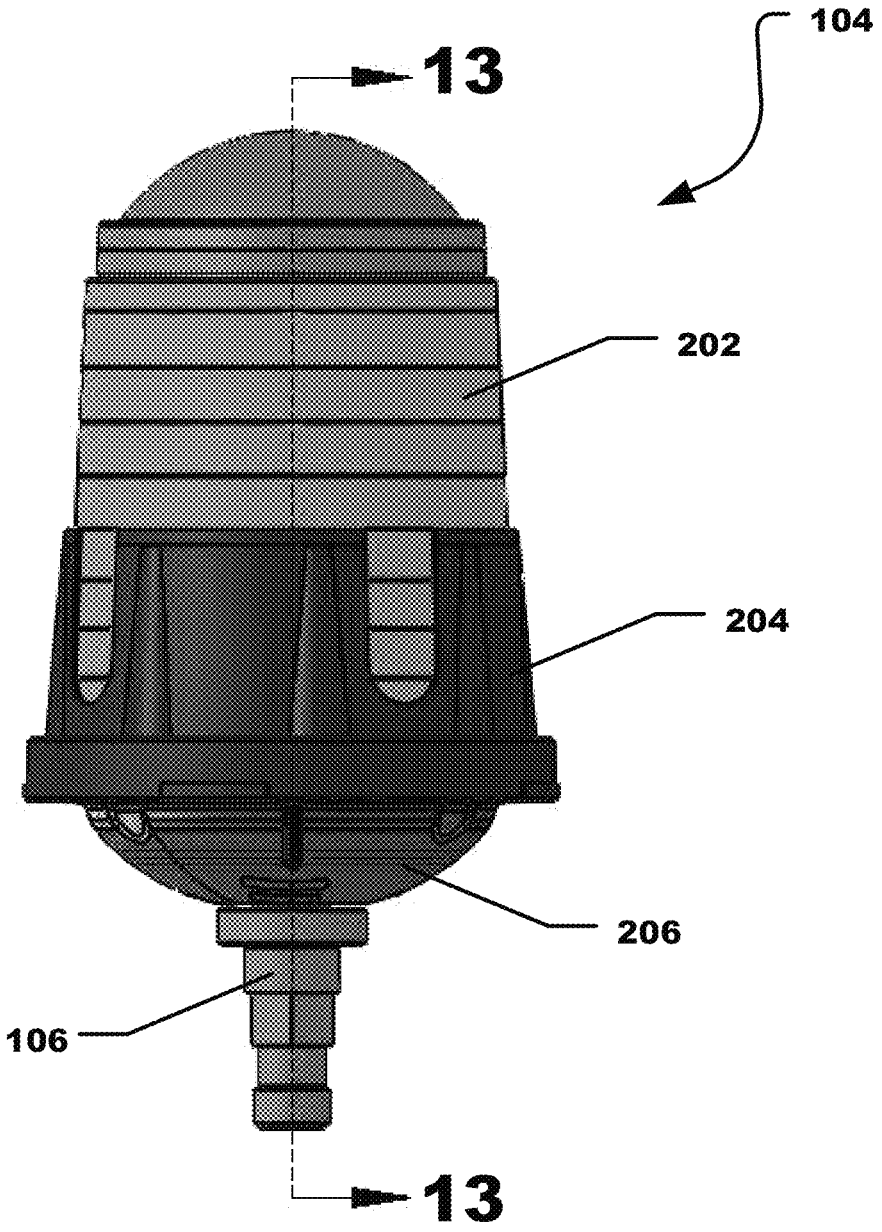
FIG. 2 includes a plan view of a paint cup assembly engaged with an adapter in accordance with a particular embodiment.
Figure 3:
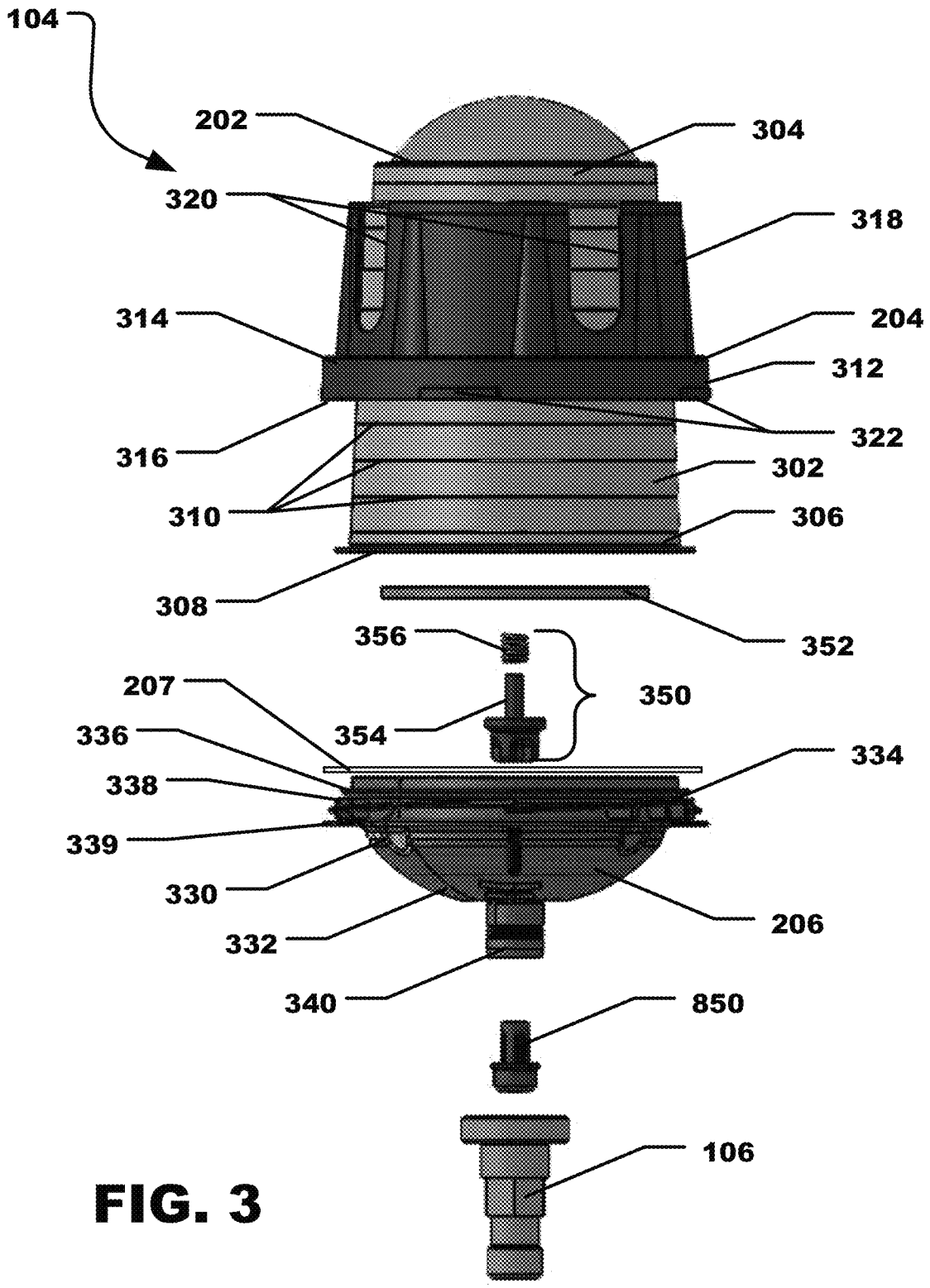
FIG. 3 includes an exploded plan view of a paint cup assembly and an adapter in accordance with a particular embodiment.

FIG. 2 through 9 illustrates details concerning the paint cup assembly 102 that is depicted in FIG. 1 in conjunction with the paint spray gun 102. Specifically, FIG. 2 and FIG. 3 show details concerning the paint cup assembly 102 in its entirety and FIG. 4 through FIG. 9 illustrate details concerning various component parts of the paint cup assembly 102.

As indicated in FIG. 2 and FIG. 3, the paint cup assembly 102 may include a paint reservoir, e.g., a paint liner 202. The paint cup assembly 102 can also include an extended ring 204 that can at least partially surround the paint liner 202. In a particular aspect, the extended ring 204 may include an axial extension, e.g., a skirt, that may extend toward a closed proximal end of the paint liner such that the ring is configured to allow a user to grasp the paint cup assembly without collapsing the paint liner during attachment with a paint sprayer. As illustrated, the paint cup assembly 102 can include a cap 206 that may be threadably engaged with the extended ring 204. As described in detail below, the cap 206 may engage the adapter 106 in order for the paint cup assembly 102 to be attached to a spray gun (not illustrated). A seal 207 can be installed between the cap 206 and the extended ring 204. In particular, the seal 207 can circumscribe a portion of the cap 206. As described further herein, the seal 207 can form a tertiary sealing structure for preventing paint from leaking from the paint cup assembly 102 during use or during storage.

FIG. 3 indicates that the paint liner 202 may include a hollow body 302 that defines a proximal end 304 and a distal end 306. The hollow body 302 may be generally frustoconical. The proximal end 304 of the hollow body 302 may be closed. Further, the proximal end 304 of the hollow body 302 may be rounded. The distal end 306 of the hollow body 302 may be open and may facilitate filling the paint liner 202 with paint, as described in detail below. The hollow body 302 may also include a rim 308 that circumscribes the distal end 306 of the hollow body 302. When the extended ring 204 is engaged with the cap 206, the rim 308 of the paint liner 202 may be captured, or otherwise trapped, between the extended ring 204 and the cap 206.

In a particular aspect, the paint liner 202, including the hollow body 302, may be transparent. In another aspect, the paint liner 202, including the hollow body 302, may be translucent. In still another aspect, the paint liner 202, including the hollow body 302, may be opaque. In still another aspect, portions of the paint liner 202 may be opaque and other portions may be transparent, translucent, or a combination thereof. For example, the paint liner 202 may substantially opaque with one or more transparent strips to facilitate measuring while filling the paint liner 202 with paint.

In a particular aspect, the paint liner 202 may be disposable. Further, in a particular aspect, the paint liner 202 may be collapsible. Specifically, the paint liner 202 may be collapsible as paint is withdrawn from within the paint liner 202. Also, in a particular aspect, the paint liner 202 may be constructed from low density polyethylene (LDPE).

As illustrated in FIG. 3, the paint liner 202 may include a plurality of indicia 310 spaced along the length of the hollow body 302 of the paint liner 202. Each of the indicia may be space along the length of the hollow body 302. Each of the indicia 310 may represent an incremental change in an internal volume of the paint liner. In a particular aspect, the plurality of indicia 310 may be lines that are printed, or otherwise disposed, on an exterior surface of the body 302. In another aspect, the plurality of indicia 310 may be printed, or otherwise disposed, on an interior surface of the body 302. In still another aspect, the plurality of indicia 310 may be printed, or otherwise disposed, on an interior surface of the body 302 and on an exterior surface of the body 302. The indicia 310 may partially circumscribe the body 302. Alternatively, the indicia 310 may fully circumscribe the body 302.

It can be appreciated that the volume between adjacent indicia is the same. Further, it can be appreciated that due to the tapered shape of the body 302 the spacing of the indicia along the body may vary.

In a particular aspect, each of the plurality of indicia 310 may be a raised rib extending from the body. Each of the ribs may extend internally into the body. Conversely, each of the ribs may extend externally, or outwardly, from the body.

In another aspect, each of the indicia 310 may serve as a crush zone to facilitate collapsing of the paint liner 202 as paint is expressed from the paint liner 202 during a spraying operation. The body 302 of the paint liner 202 may have a body wall thickness and each of the indicia 310 may have an indicia wall thickness and wherein the indicia wall thickness is less than the body wall thickness.

In a particular aspect, the indicia wall thickness is less than or equal to ninety percent (90%) of the body wall thickness. In another aspect, the indicia wall thickness is less than or equal to eighty-five percent (85%) of the body wall thickness. In yet another aspect, the indicia wall thickness is less than or equal to eighty percent (80%) of the body wall thickness. In still another aspect, the indicia wall thickness is less than or equal to seventy-five percent (75%) of the body wall thickness. In another aspect, the indicia wall thickness is less than or equal to seventy percent (70%) of the body wall thickness. In still yet another aspect, the indicia wall thickness is less than or equal to sixty-five percent (65%) of the body wall thickness. In yet another aspect, the indicia wall thickness is less than or equal to sixty percent (60%) of the body wall thickness.

In another aspect, the indicia wall thickness is less than or equal to fifty-five percent (55%) of the body wall thickness. In still another aspect, the indicia wall thickness is less than or equal to fifty percent (50%) of the body wall thickness. In another aspect, the indicia wall thickness is less than or equal to forty-five percent (45%) of the body wall thickness. In another aspect, the indicia wall thickness is less than or equal to forty percent (40%) of the body wall thickness. In yet another aspect, the indicia wall thickness is less than or equal to thirty-five percent (35%) of the body wall thickness. Further, in another aspect, the indicia wall thickness is less than or equal to thirty percent (30%) of the body wall thickness. In still another aspect, the indicia wall thickness is less than or equal to twenty-five percent (25%) of the body wall thickness. In another aspect, the indicia wall thickness is not less twenty percent (20%) of the body wall thickness.

Returning to FIG. 3, the extended ring 204 may include a hub 312 having a proximal end 314 and a distal end 316. As illustrated, a skirt 318 may extend longitudinally from the proximal end 314 of the hub 312. The skirt 318 may be formed with a plurality of slots 320. The slots 320 may allow a user to see the indicia 310 on the paint liner 202 while filling the paint liner 202 with paint. FIG. 3 indicates that the distal end 316 of the hub 312 may be formed with a plurality of teeth 322 that extend radially from the hub 312. Accordingly, when viewed from the distal end 316, the hub 312 of the extended ring 204 may have a gear, or cog, shape. This gear, or cog, shape is configured to key the paint cup assembly 104 to a filling station, described in detail below, during filling. Specifically, the gear shape is configured to fit into a correspondingly shaped hole formed in a filling station in order to prevent the paint cup assembly 104 from rotating within the hole as the extended ring 204 is engaged with the cap 206.

The hub 312 may include an interior surface (not illustrated) that may be formed with a plurality of internal threads. As such, the hub 312, and the extended ring 204, may be configured to threadably engage the cap 206. When assembled, as illustrated in FIG. 2, the skirt 318 of the extended ring 204 may at least partially surround the paint liner 202. Further, the skirt 318 may extend at least partially along the length of the paint liner 202. In a particular aspect, the skirt 318 is substantially rigid and the skirt 318 may be configured to be grasped without collapsing the paint liner 202. Particularly, the extended ring 204 may be constructed from twenty percent (20%) talc filled polypropylene.

As further illustrated in FIG. 3, the cap 206 of the paint cup assembly 104 may include generally hemispherical hollow body 329 having a proximal end 330 and a distal end 332. The proximal end 330 of the cap 206 may be formed with a plurality of external threads 334 that are configured to engage the internal threads (not illustrated) formed in the hub 312 of the extended ring 204. The cap 206 may also include a primary sealing structure 336 and a secondary sealing structure 338. The cap 206 may also include an external rim 339 having an external diameter. The primary sealing structure 336 can be located at a distance from the external rim 339 and the secondary sealing structure 338 can be located between the primary sealing structure 336 and the external rim 339. Further, the seal 207 can be disposed around the hollow body 329 near the external threads 334 and abutting the external rim 339.

During use, the extended ring 204 may be threaded onto the cap 206 and the rim 308 of the paint liner 202 may be sandwiched between the extended ring 204 and the cap 206. A primary seal can be established between the rim 308 of the paint liner 202 and the primary sealing structure 336 on the cap 206. The primary seal substantially prevents fluid from leaking through the interface established by the paint liner 202 and the cap 206. A secondary seal can established between secondary sealing structure 338 on the cap 206 and the hub 312 of the extended ring 204. The secondary seal can substantially prevent fluid from leaking through the interface established by the cap 206 and the extended ring 204. The seal 207 can be compressed between distal end 316 of the hub 312 of the extended ring 204 and the external rim 339 of the cap 206, as the extended ring 204 is threaded on the cap 206, to form a tertiary seal between the distal end 316 of the hub 312 and the external rim 339 of the cap 206.

Accordingly, when the paint cup assembly 104 is filled with fluid and assembled as illustrated in FIG. 1, the paint cup assembly 104 may be shaken to stir, or otherwise mix, the fluid within the paint cup assembly 104.

As illustrated in FIG. 3, the cap 206 may include an outlet tube 340 that may extend from the distal end 332 of the cap 206. Specifically, the outlet tube 340 may extend from the center of the distal end 332 of the cap 206. The outlet tube 340 may be configured to be removably engaged with the adapter 106. For example, the outlet tube 340 may be formed with external threads (not illustrated).

Figure 4:
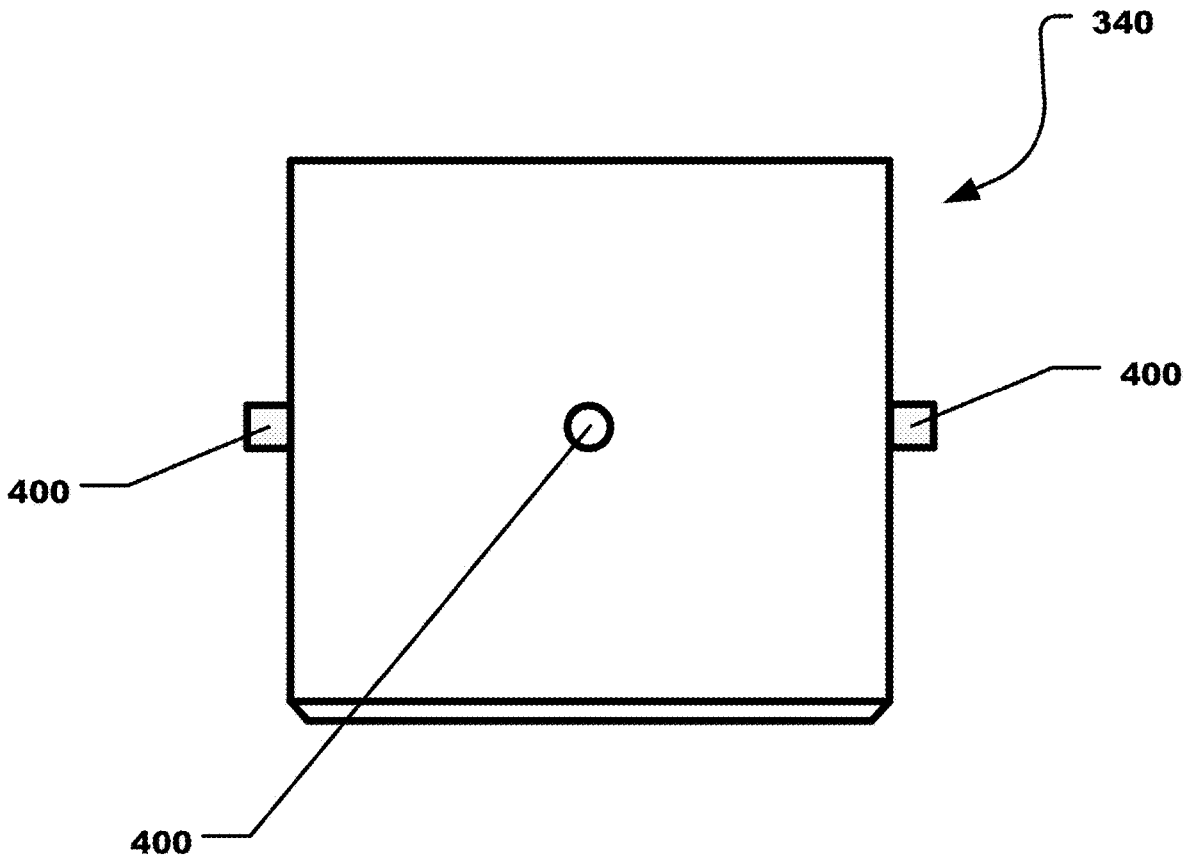
FIG. 4 includes a detailed plan view of a first embodiment of a paint cup assembly outlet tube in accordance with a particular embodiment.

Alternatively, as illustrated in FIG. 4, the outlet tube 340 may be formed within one or more locking pins 400 that may extend radially outward from the outlet tube 340. The locking pins 400 may be configured to engage one or more grooves, or slots, formed within the adapter 106. Examples of grooves or slots formed within the adapter 106 are described below in conjunction with FIG. 10 and FIG. 11.

Figure 5:
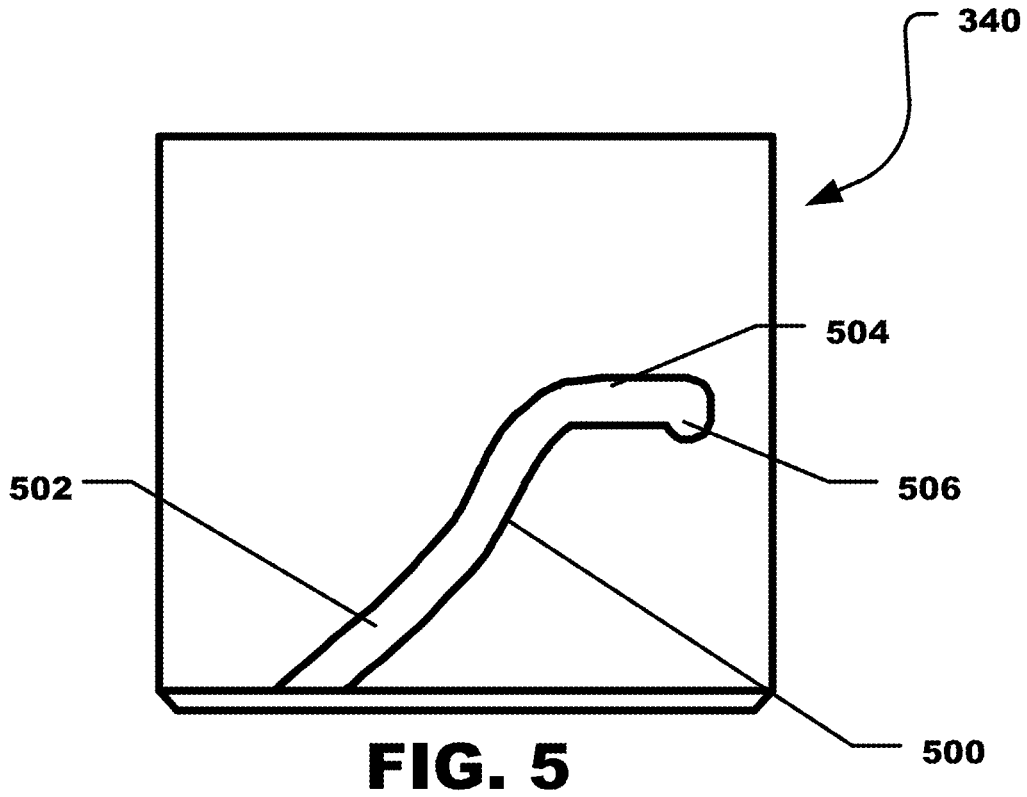
FIG. 5 includes a detailed plan view of a second embodiment of a paint cup assembly outlet tube in accordance with a particular embodiment.

In another aspect, the outlet tube 340 may be formed with one or more grooves configured to engage one or more locking pins within the adapter. FIG. 5 illustrates one such groove, generally designated 500. As such, the groove 500 may include a generally helical portion 502 that extends to a relatively straight portion 504. The relatively straight portion 504 is substantially parallel to the end face of the outlet tube 340. To install the paint cup assembly 104 (FIG. 3) within the adapter 106 (FIG. 3), the outlet tube 340 may be inserted into the adapter 106 (FIG. 3) such that the groove 500, or grooves, fit over corresponding locking pins. Thereafter, the paint cup assembly 104 (FIG. 3) may be rotated in order to move the groove 500, or grooves, over the locking pins until the paint cup assembly 104 (FIG. 3) is essentially locked in placed within the adapter 106 (FIG. 3).

It can be appreciated that a spring in a valve assembly, described below, may provide a biasing force to facilitate locking the paint cup assembly 104 (FIG. 3) within the adapter 106 (FIG. 3). Further, it can be appreciated that the relatively straight portion 504 may be slightly angled toward to the end face of the outlet tube 340 in order to provide a ramped structure to further facilitate locking the paint cup assembly 104 (FIG. 3) within the adapter 106 (FIG. 3). For example, the relatively straight portion 504 may be angled in a range of one degree to twenty degrees (1°-20°) relative to a line parallel to the end face of the outlet tube 340. Additionally, the relatively straight portion 504 may terminate in a notch 506, or divot. A locking pin may move into the notch 506 and may further secure attachment of the paint cup assembly 104 (FIG. 3) to the adapter (FIG. 3).

Figure 6:
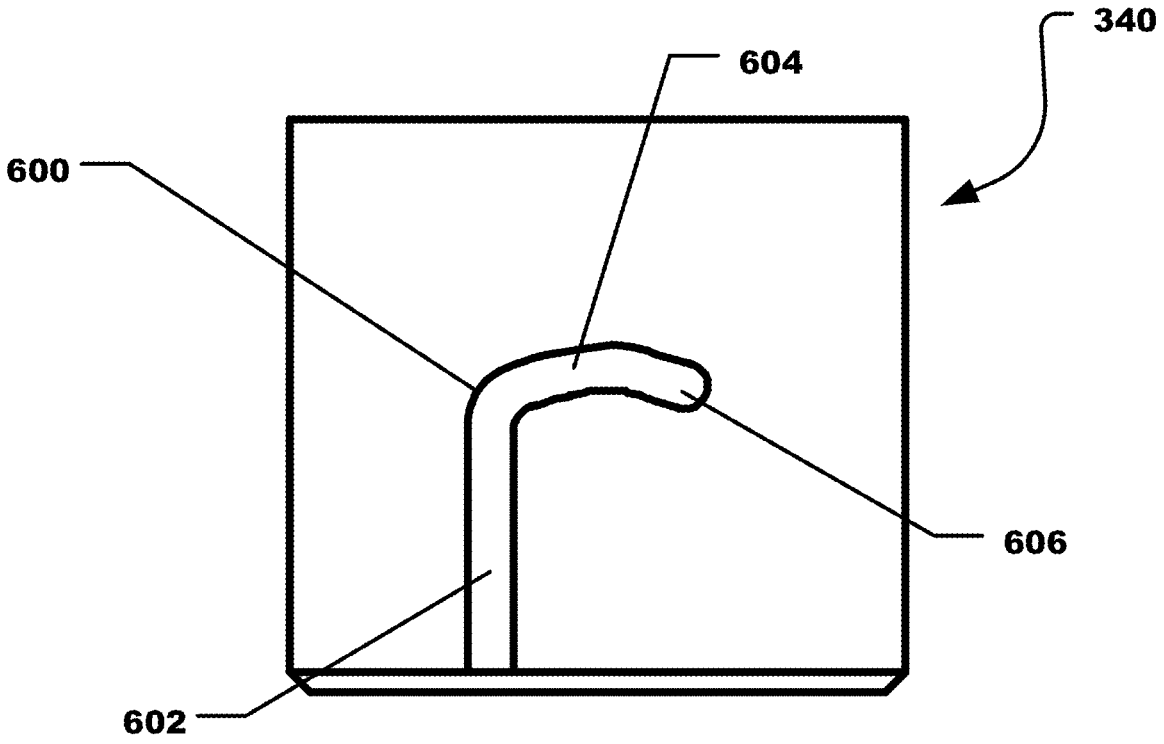
FIG. 6 includes a detailed plan view of a third embodiment of a paint cup assembly outlet tube in accordance with a particular embodiment.

FIG. 6 illustrates another groove, generally designated 600. As illustrated, the groove 600 may include a vertical portion 602 that is substantially perpendicular to the end face of the outlet tube 304. The vertical portion 602 leads to a first angled portion 604 that is angled away from the end face of the outlet tube 304, e.g., in a range of one degree to twenty degrees (1°-20°). The first portion 604 may be angled with respect to a line parallel to the end face of the outlet tube 304. A second angled portion 606 extends from the first angled portion 604 in the opposite direction as the first angled portion 604, i.e., toward the end face of the outlet tube 304. The second angled portion 606 may be angled in a range of one degree to twenty degrees (1°-20°). The second angled portion 606 may be angled with respect to a line parallel to the end face of the outlet tube 304.

In a particular aspect, the cap 206 may be constructed from polypropylene (PP).

FIG. 3 indicates that the paint cup assembly 104 may include a valve assembly 350. The valve assembly 350 may be installed within the cap 206. Specifically, the valve assembly 350 may be installed within the cap 206 between the outlet tube 340 and a valve retainer 352. The valve assembly 350 may include a plunger 354 and a spring 356. In another aspect, the valve assembly 350 may include a ball (not illustrated) in lieu of a plunger.

In a particular aspect, the plunger 354 may be constructed from a thermoplastic elastomer (TPE). Further, the spring 365 may be a conical compression spring made from stainless steel.

Figure 7:
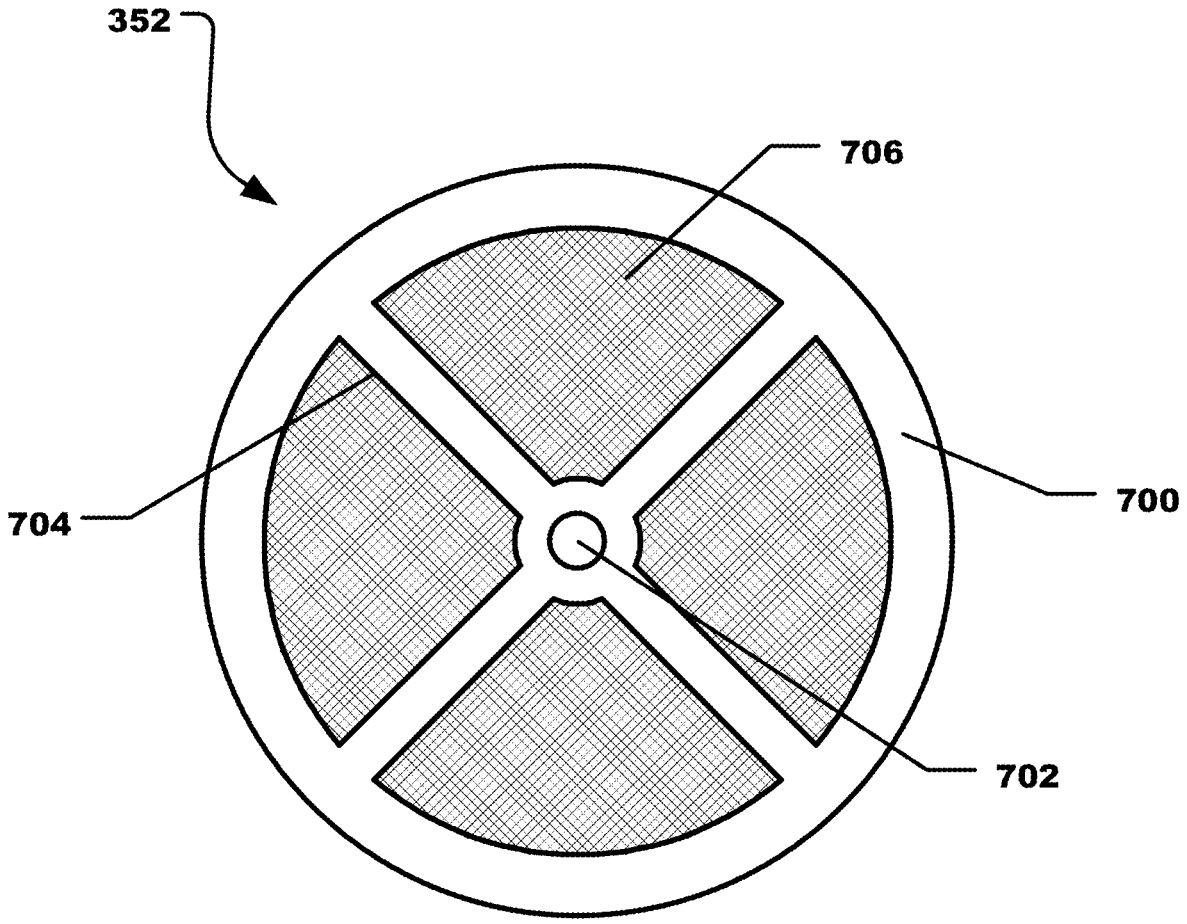
FIG. 7 includes a plan view of a valve retainer in accordance with a particular embodiment.

As illustrated in FIG. 7, the valve retainer 352 include a generally disk shaped frame 700. The frame 700 of the valve retainer 352 may be formed with a central opening 702 through which a portion of the plunger 354 may extend through after installation and during operation of the valve assembly 350, as described below. FIG. 7 depicts that the frame 700 of valve retainer 352 may include one or more windows 704, or openings, formed therein. A filter material 706, e.g., a mesh type material, may be disposed within each window 704. In a particular aspect, the frame 700 may include an upper portion and a lower portion and the filter material 706 may be sandwiched there between. In another aspect, the frame 700 may be a single piece and formed with the windows 704 and the filter material 706 may be welded to an upper surface or lower surface of the frame 700.

In a particular aspect, the frame 700 of the valve retainer 352 may be constructed from polypropylene. Further, the filter material 706 may be a mesh type material suitable for filtering a fluid such as paint.

Figure 8:
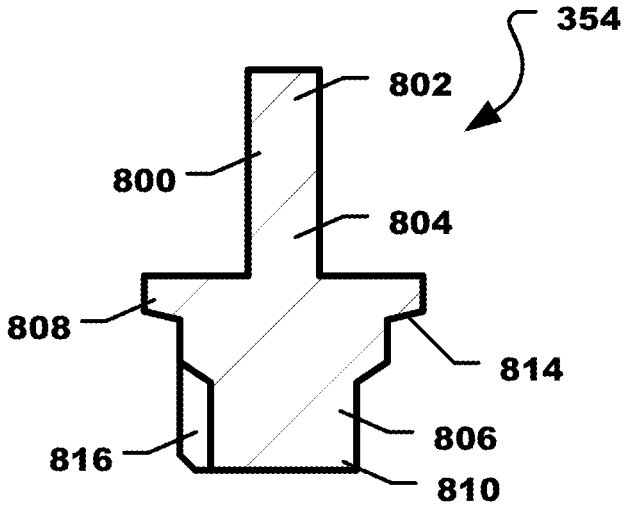
FIG. 8 includes a cross-sectional view of a valve plunger in accordance with a particular embodiment.

As illustrated in FIG. 8, the plunger 354 may include a shaft 800 that may include a proximal end 802 and a distal end 804. A head 806 may extend from the distal end 804 of the shaft 800. The head 806 of the plunger 354 may include a proximal end 808 and a distal end 810. A sealing collar 812 may extend radially from the proximal end 808 of the head 806. The sealing collar 812 may be formed with a sealing face 814. The sealing face 814 of the sealing collar 812 is configured to engage a valve seat, described below, formed in the outlet tube 340 (FIG. 3) of the cap 206 (FIG. 3). When the sealing face 814 engages the valve seat, flow through the outlet tube 340 (FIG. 3) is substantially blocked and the paint cup assembly 104 (FIG. 3) is sealed.

FIG. 8 depicts that the head 806 of the plunger 354 may be formed with one or more flutes 816. The flutes 816 may facilitate fluid flow through the paint cup assembly 104 (FIG. 3) when the sealing face 814 is disengaged from the valve seat.

Figure 9:
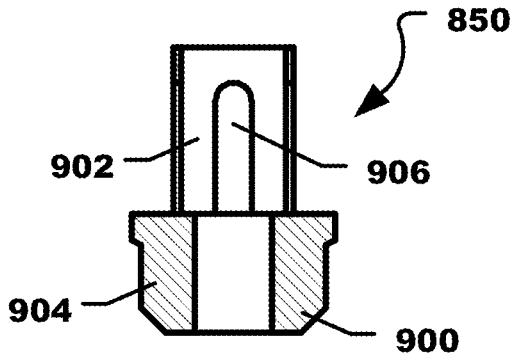
FIG. 9 includes a cross-sectional view of a valve actuator in accordance with a particular embodiment.

Returning to FIG. 3, the paint cup assembly 104 may further include the adapter 106. A valve actuator 850 may be installed within the adapter 106. FIG. 9 illustrates further details concerning the valve actuator 850 and FIG. 10 illustrates further details regarding the adapter 106.

As illustrated in FIG. 9, the valve actuator 850 may include a generally cylindrical, base 900. A generally cylindrical, hollow post 902 may extend from the base 900. As illustrated, the base 900 may be formed with a central bore 904. Further, the post 902 may be formed with one or more slots 906, or openings. The slots 906 are configured to allow fluid, e.g., paint, to flow through the post 902 and the base 900 when the valve assembly 350 (FIG. 3) is in the open configuration. In a particular embodiment, the post 902 is configured to engage the plunger 354 (FIG. 3, FIG. 8) and move the plunger 354 linearly in order to disengage the sealing face 814 (FIG. 8) of the plunger 354 (FIG. 8) from the valve seat, described in detail below in conjunction with FIG. 13.

In a particular aspect, the valve actuator 850 may be constructed from nylon.

Figure 10:
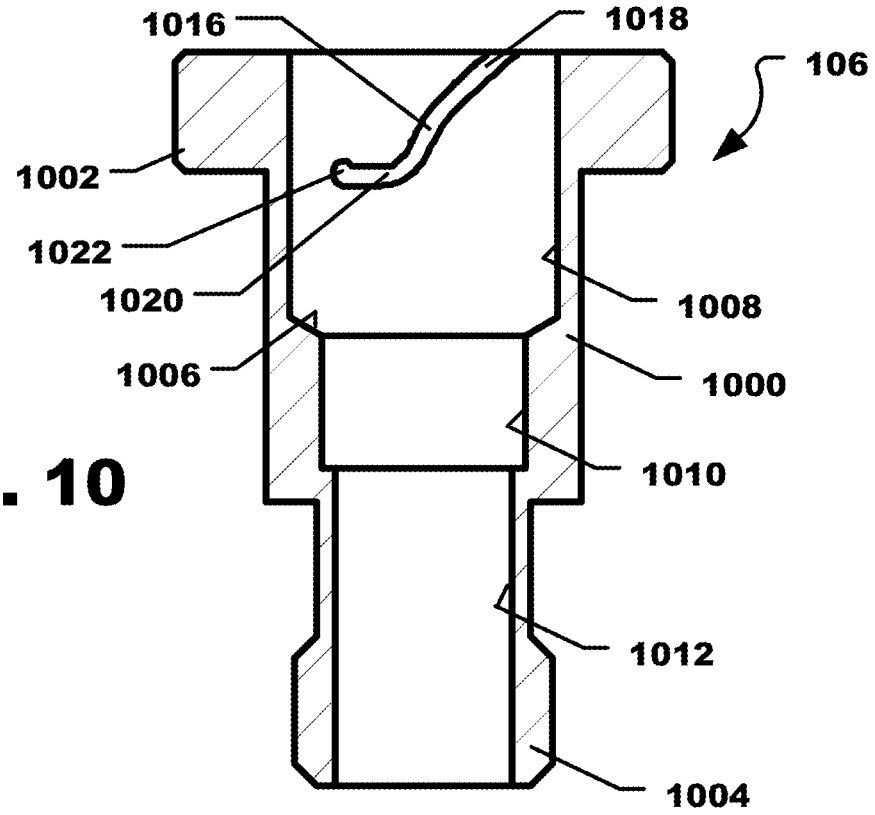
FIG. 10 includes a cross-sectional view of a first embodiment of an adapter in accordance with a particular embodiment.

FIG. 10 depicts details concerning the construction of the adapter 106. As illustrated, the adapter 106 may include an adapter body 1000 that may define a proximal end 1002 and a distal end 1004. Further, the adapter 106 may include an internal bore 1006 along the length of the adapter body 1000. The internal bore 1006 may include a first bore portion 1008 that may extend from the proximal end 1002 of the adapter body 1000 toward the distal end 1004 of the adapter body 1002. Further, the internal bore 1006 may include a second bore portion 1010 that may extend from the first bore portion 1008 toward the distal end 1004 of the adapter body 1002. A third bore portion 1012 may extend from the second bore portion 1010 and terminate at the distal end 1004 of the adapter body 1002.

In a particular aspect, the base 900 (FIG. 9) of the valve actuator 354 (FIG. 3) is sized and shaped to fit into the second bore portion 1010 of the internal bore 1006 formed in the adapter body 1000. Moreover, the base 900 (FIG. 9) of the valve actuator 354 (FIG. 3) may be press fitted into the second bore portion 1010.

As illustrated in FIG. 10, the first bore portion 1008 may be formed with one or more grooves 1016 configured to engage one or more locking pins 400 (FIG. 4) extending radially from the outlet tube 340 (FIG. 4) of the cap 206 (FIG. 3). The groove 1016 may include a generally helical portion 1018 that extends to a relatively straight portion 1020. The relatively straight portion 1020 is substantially parallel to the end face of the adapter 106. To install the paint cup assembly 104 (FIG. 3) within the adapter 106 (FIG. 3), the outlet tube 340 (FIG. 3) may be inserted into the adapter 106 (FIG. 3) such that the locking pins 400 (FIG. 4) fit into corresponding grooves 1016. Thereafter, the paint cup assembly 104 (FIG. 3) may be rotated in order to move the locking pins 400 (FIG. 4) within the grooves 1016 until the paint cup assembly 104 (FIG. 3) is essentially locked in placed within the adapter 106 (FIG. 3).

It can be appreciated that the relatively straight portion 1020 may be slightly angled toward to the end face of the adapter 106 in order to provide a ramped structure to further facilitate locking the paint cup assembly 104 (FIG. 3) within the adapter 106 (FIG. 3). For example, the relatively straight portion 1020 may be angled in a range of one degree to twenty degrees (1°-20°) relative to a line parallel to the end face of the adapter 106. Additionally, the relatively straight portion 1020 may terminate in a notch 1022, or divot. A locking pin may move into the notch 1022 and may further secure attachment of the paint cup assembly 104 (FIG. 3) to the adapter 106 (FIG. 3).

Figure 11:
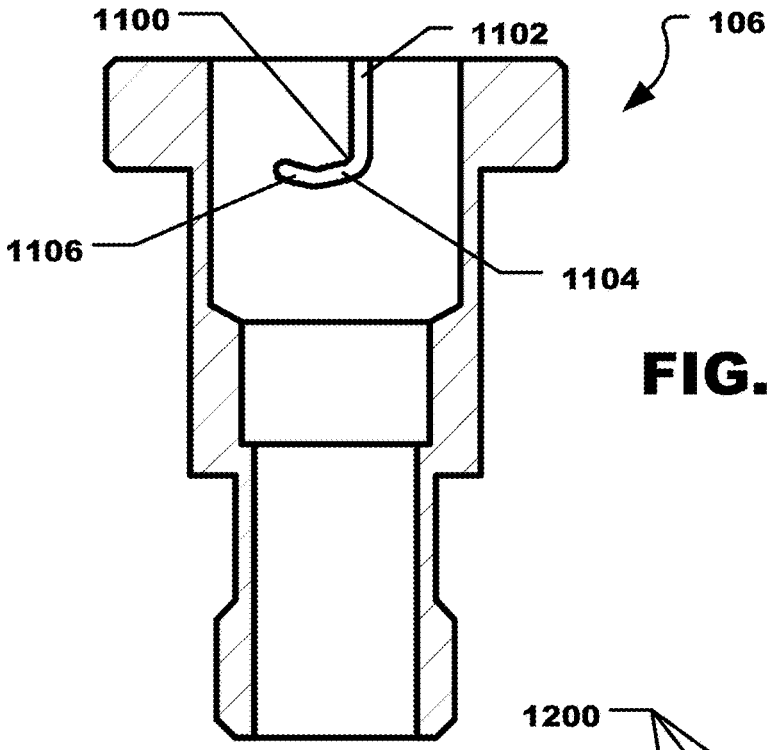
FIG. 11 includes a cross-sectional view of a second embodiment of an adapter in accordance with a particular embodiment.

FIG. 11 illustrates another groove, generally designated 1100, that may be formed in the adapter 106. As illustrated, the groove 1100 may include a vertical portion 1102 that is substantially perpendicular to the end face of the adapter 106. The vertical portion 1102 leads to a first angled portion 1104 that is angled away from the end face of the adapter 106, e.g., in a range of one degree to twenty degrees (1°-20°). The first portion 1104 may be angled with respect to a line parallel to the end face of the adapter 106. A second angled portion 1106 extends from the first angled portion 1104 in the opposite direction as the first angled portion 1104, i.e., toward the end face of the adapter 106. The second angled portion 1106 may be angled in a range of one degree to twenty degrees (1°-20°). The second angled portion 1106 may be angled with respect to a line parallel to the end face of the adapter 106.

Figure 12:
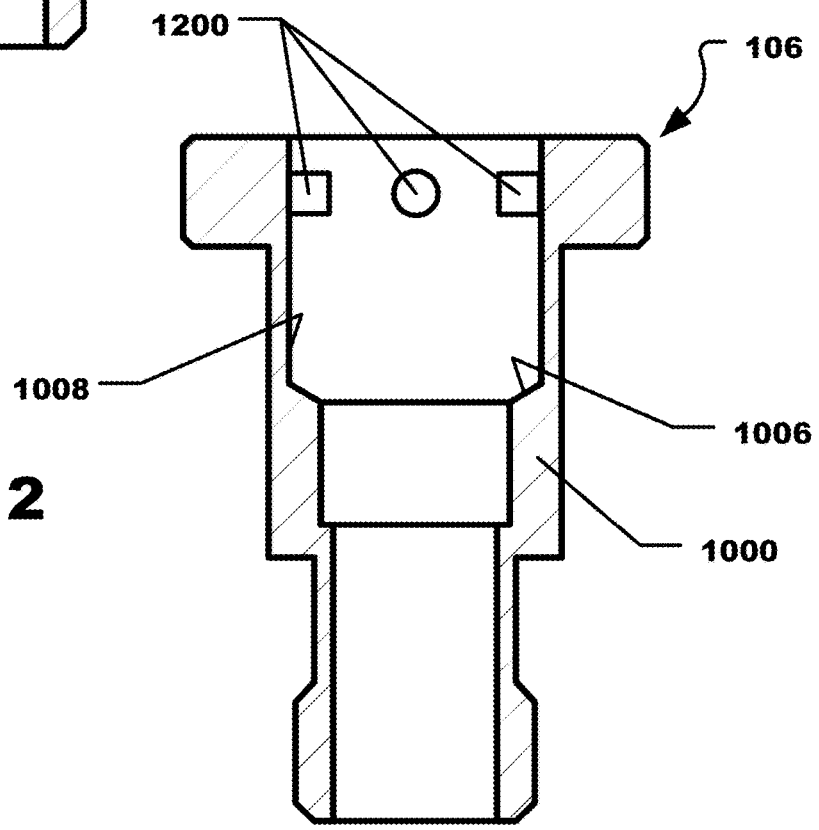
FIG. 12 includes a cross-sectional view of a third embodiment of an adapter in accordance with a particular embodiment.

As illustrated in FIG. 12, the adapter 106 may be formed within one or more locking pins 1200 that may extend radially inward from the adapter body 1000. For example, the locking pins 1200 may extend radially inward from the wall of the first bore portion 1008 of the internal bore 1006 formed in the adapter body 1000. In a particular aspect, the locking pins 1200 may be configured to engage one or more grooves, or slots, formed within the outlet tube 340 of the cap 206.

In a particular aspect, the adapter 106 may be constructed from aluminum.

Figure 13:
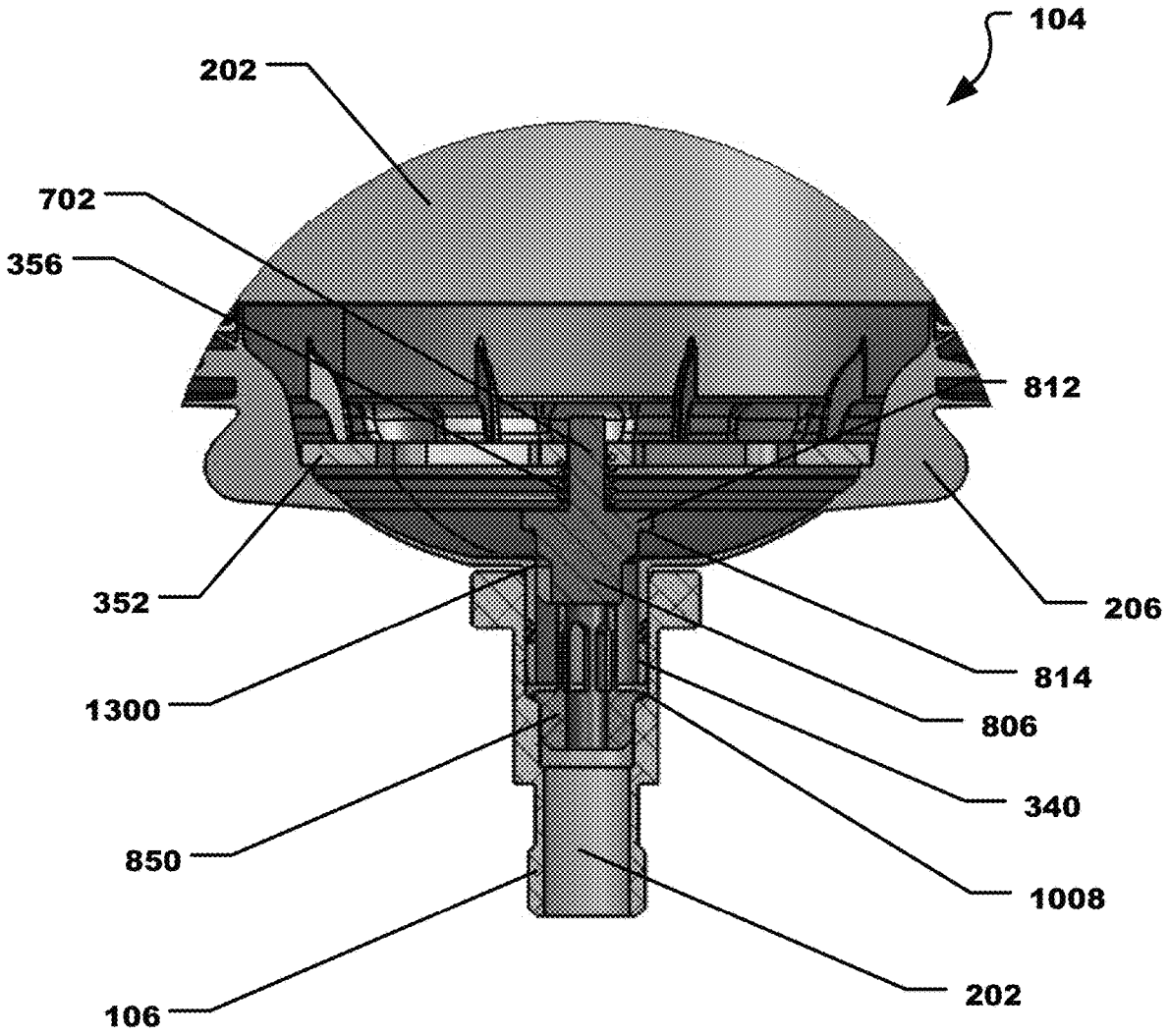
FIG. 13 includes a cross-sectional view of the paint cup assembly taken along line 13-13 in FIG. 2 in accordance with a particular embodiment.

Referring now to FIG. 13, a detailed view of the paint cup assembly 104 is illustrated. FIG. 13 depicts the outlet tube 340 of the cap 206 inserted into the first bore portion 1008 of the internal bore 1006 formed in the adapter 106. As the outlet tube 340 is inserted into the adapter 106, the valve actuator 850 within the adapter 106 may engage the plunger 354 of the valve assembly 350. Specifically, the post 902 of the valve actuator 850 can contact and engage the head 806 of the plunger 354.

The post 902 of the valve actuator 850 can cause the plunger 354 to move linearly into the cap 206 and through the valve retainer 352, e.g., through the central opening 702 of the valve retainer 352. As the plunger 354 moves as described, the spring 356 is compressed between the valve retainer 352 and the head 806 of the plunger 354. Further, as the plunger 354 moves into the cap 206, the sealing face 814 formed in the sealing collar 812 of the head 806 may be unseated, or otherwise disengaged, from a valve seat 1300 formed within the cap 206 at the base of the outlet tube 340.

As the sealing face 814 of the head 806 is unseated from the valve seat 1300 of the outlet tube 340, fluid, e.g., paint, may flow from the paint liner 202 through the cap 206 and out of the outlet tube 340. The fluid may then flow through the valve actuator 850 and through the adapter 106 into a paint sprayer. As the fluid flows through the cap 206, the filter material 706 (FIG. 7) disposed within the valve retainer 352 may filter the fluid.

Accordingly, as illustrated in FIG. 13, the valve assembly 350 is configured to be operable from a closed configuration in which fluid flow through the outlet tube 340 is prevented to an open configuration in which fluid flow through the outlet tube 340 is permitted upon engagement with a paint sprayer. In particular, the open configuration may be achieved automatically during engagement of the paint cup assembly 104 with the adapter 106 or paint sprayer (not illustrated). Further, it may be appreciated that the engagement may be achieved by reducing a distance between the paint cup assembly and the adapter 106 or paint sprayer (not illustrated). Further, in a particular embodiment, engagement may include an interference fi. In another aspect, engagement may include a threaded engagement.

Figure 14:
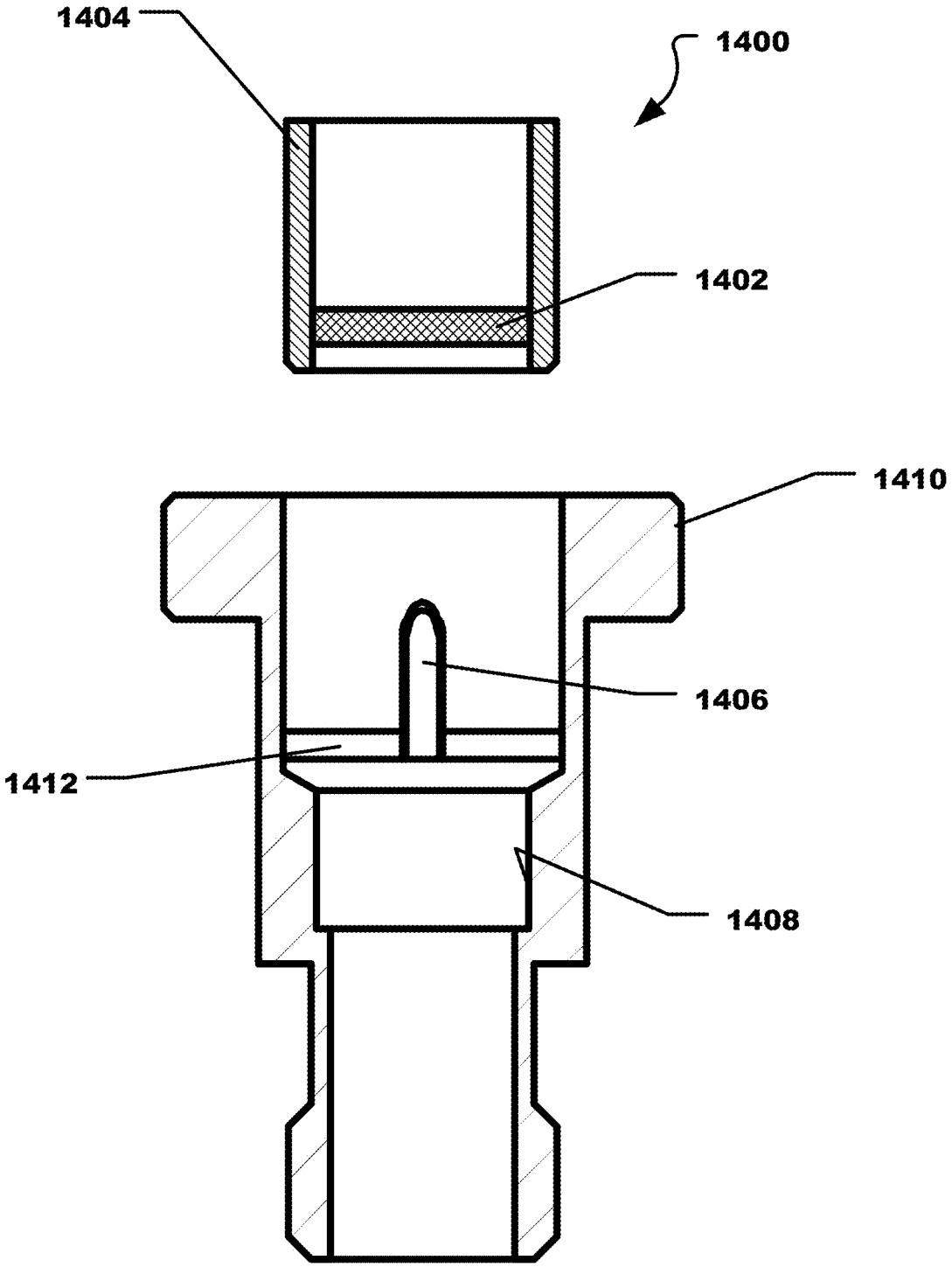
FIG. 14 includes a detailed plan view of a third embodiment of a paint cup assembly valve assembly in accordance with a particular embodiment.

Referring to FIG. 14, a third embodiment of a valve assembly is illustrated and is designated 1400. As illustrated, the valve assembly 1400 may include a membrane 1402 disposed within an outlet tube 1404 of a cap (not illustrated). In particular aspect, the membrane 1402 may be self-sealing.

The valve assembly 1400 may further include a trocar 1406 or a similarly configured needle or piercing hollow shaft. The trocar 1406 may be disposed within an internal bore 1408 of an adapter 1410. The trocar 1406 may be supported by one or more support structures 1412 that extend radially from a base of the trocar 1406 to the wall of the internal bore 1408.

As a paint cup assembly (not illustrated) is engaged with the adapter 1410, the outlet tube 1404 of the cap (not illustrated) may be inserted into the internal bore 1408 of the adapter 1410. Further, as the outlet tube 1404 is pushed into the adapter, the trocar 1406 may pierce the membrane 1402 in order to permit fluid flow out of the paint cup assembly (not illustrated) and through the adapter 1410 into a paint sprayer (not illustrated).

When the paint cup assembly (not illustrated) is disengaged from the adapter 1410, the trocar 1406 may be retracted, or otherwise removed, from the membrane 1402. Once the trocar 1406 is removed from the membrane 1402, the membrane 1402 may seal the hole formed at the location within the membrane 1402 in which the trocar 1406 pierced the membrane 1402. As such, if the paint cup assembly (not illustrated) remains at least partially filled with fluid, leakage of the fluid is substantially minimized.

Figure 15:
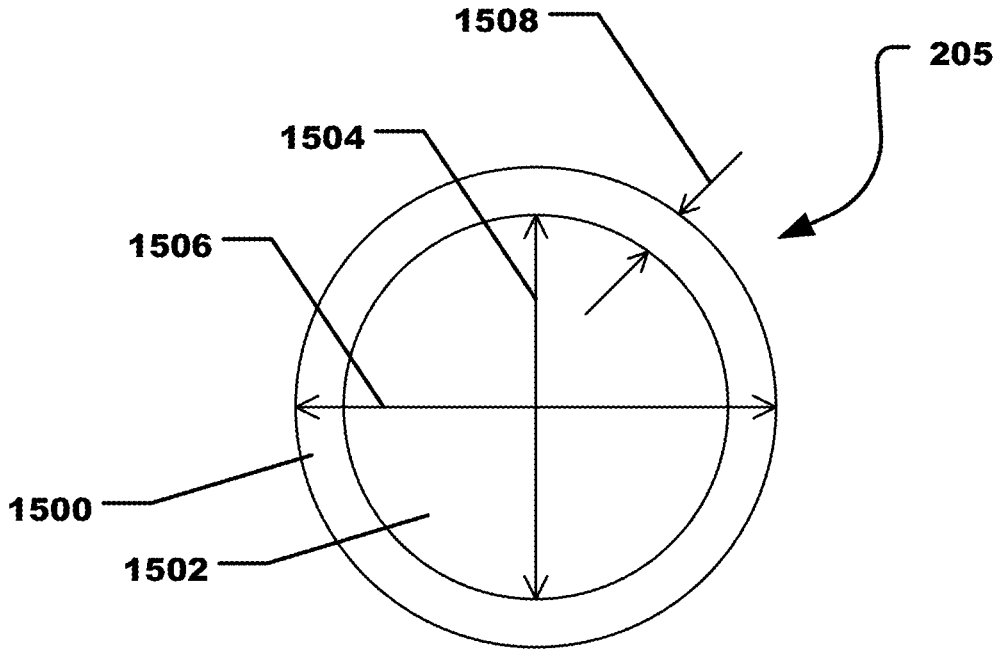
FIG. 15 includes a top plan view of a seal in accordance with a particular embodiment.
Figure 16:
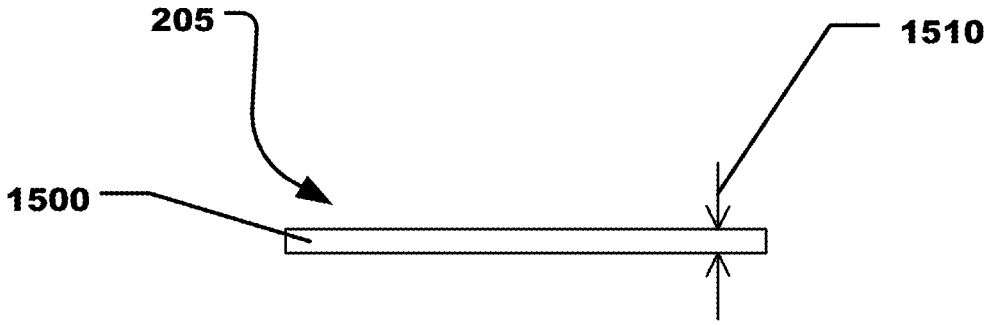
FIG. 16 includes a side plan view of a seal in accordance with a particular embodiment.

FIG. 15 and FIG. 16 depict details concerning the seal 207. As illustrated, the seal 207 can include a generally annular body 1500 that defines a central opening 1502. The seal 207 can include an internal diameter 1504 and an external diameter 1506. Further, the seal 207 can include a width 1508 that can be the difference between the external diameter 1506 and the internal diameter 1504. The seal 207 can also include a thickness 1510.

In a particular aspect, the seal 207 can include a polymer. The polymer can include a thermoset polymer. Moreover, the thermoset polymer can include polyethylene, polyethylene foam, or a combination thereof. The polyethylene foam can include a closed cell polyethylene foam. In another aspect, the seal 207 can include a hydrophobic polymer.

In a particular aspect, the seal 207 can include a seal width 1508 of at least about 4 mm. For example, the seal width 1508 can be at least about 5 mm, at least about 6 mm, at least about 7 mm, or at least about 8 mm. The seal width 1508 can also be limited. For example, the seal width 1508 may be no greater than about 12.5 mm, no greater than about 12.0 mm, no greater than about 11.0 mm, or no greater than about 10.0 mm. The seal width 1508 can be in a range between and including any of the minimum or maximum widths described above.

For example, the seal width 1508 can be ≥5 mm and ≤12.5 mm, such as ≥5 mm and ≤12.0 mm, ≥5 mm and ≤11.0 mm, or ≥5 mm and ≤10.0 mm. In another aspect, the seal width 1508 can be ≥6 mm and ≤12.5 mm, such as ≥6 mm and ≤12.0 mm, ≥6 mm and ≤11.0 mm, or ≥6 mm and ≤10.0 mm. Further, the seal width 1508 can be ≥7 mm and ≤12.5 mm, such as ≥7 mm and ≤12.0 mm, ≥7 mm and ≤11.0 mm, or ≥7 mm and ≤10.0 mm. Moreover, the seal width 1508 can be ≥8 mm and ≤12.5 mm, such as ≥8 mm and ≤12.0 mm, ≥8 mm and ≤11.0 mm, or ≥8 mm and ≤10.0 mm.

In another aspect, the seal width 1508 can be at least 4% of the outer diameter, OD, of the external rim 339 of the cap 206. For example, the seal width 1508 can be at least 4.5% of the outer diameter, at least 5.0% of the outer diameter, at least 5.5% of the outer diameter, at least 6.0% of the outer diameter, or at least 6.5% of the outer diameter of the external rim 339 of the cap 206. The seal width 1508 may be limited and may not be greater than 10% of the outer diameter of the external rim 339 of the cap 206. Further, the seal width 1508 may not be greater than 9% of the outer diameter or 8% of the outer diameter. The seal width 1508 can be in a range between and including any of the minimum or maximum percentage values described above.

For example, the seal width 1508 can be ≥4% OD and ≤10% OD, such as ≥4% OD and ≤9% OD, or ≥4% OD and ≤8% OD. Further, the seal width 1508 can be ≥4.5% OD and ≤10% OD, such as ≥4.5% OD and ≤9% OD, or ≥4.5% OD and ≤8% OD. The seal width 1508 can be ≥5% OD and ≤10% OD, such as ≥5% OD and ≤9% OD, or ≥5% OD and ≤8% OD. Moreover, the seal width 1508 can be ≥5.5% OD and ≤10% OD, such as ≥5.5% OD and ≤9% OD, or ≥5.5% OD and ≤8% OD. The seal width 1508 can be ≥6.0% OD and ≤10% OD, such as ≥6.0% OD and ≤9% OD, or ≥6.0% OD and ≤8% OD. Further still, the seal width 1508 can be ≥6.5% OD and ≤10% OD, such as ≥6.5% OD and ≤9% OD, or ≥6.5% OD and ≤8% OD.

In another particular aspect, seal thickness 1510 can be at least about 0.5 mm. Further, the seal thickness 1510 can be at least about 0.75 mm, at least about 1.0 mm, at least about 1.25 mm, at least about 1.5 mm, at least about 1.75 mm, or at least about 2.0 mm. However, the seal thickness 1510 may be limited and may be no greater than about 3.5 mm, no greater than about 3.25 mm, no greater than about 3.0 mm, no greater than about 2.75 mm, no greater than about 2.5 mm, or no greater than about 2.25 mm. The seal thickness 1510 can be in a range between and including any of the minimum or maximum thicknesses described above.

For example, the seal thickness can be ≥0.5 mm and ≤3.5 mm, such as ≥0.5 mm and ≤3.25 mm, ≥0.5 mm and ≤3.0 mm, ≥0.5 mm and ≤2.75 mm, ≥0.5 mm and ≤2.5 mm, or ≥0.5 mm and ≤2.25 mm. In another aspect, the seal thickness can be ≥0.75 mm and ≤3.5 mm, such as ≥0.75 mm and ≤3.25 mm, ≥0.75 mm and ≤3.0 mm, ≥0.75 mm and ≤2.75 mm, ≥0.75 mm and ≤2.5 mm, or ≥0.75 mm and ≤2.25 mm. Moreover, the seal thickness can be ≥1.0 mm and ≤3.5 mm, such as ≥1.0 mm and ≤3.25 mm, ≥1.0 mm and ≤3.0 mm, ≥1.0 mm and ≤2.75 mm, ≥1.0 mm and ≤2.5 mm, or ≥1.0 mm and ≤2.25 mm. The seal thickness can be ≥1.5 mm and ≤3.5 mm, such as ≥1.5 mm and ≤3.25 mm, ≥1.5 mm and ≤3.0 mm, ≥1.5 mm and ≤2.75 mm, ≥1.5 mm and ≤2.5 mm, or ≥1.5 mm and ≤2.25 mm. Further, the seal thickness can be ≥1.75 mm and ≤3.5 mm, such as ≥1.75 mm and ≤3.25 mm, ≥1.75 mm and ≤3.0 mm, ≥1.75 mm and ≤2.75 mm, ≥1.75 mm and ≤2.5 mm, or ≥1.75 mm and ≤2.25 mm. Still further, the seal thickness can be ≥2.0 mm and ≤3.5 mm, such as ≥2.0 mm and ≤3.25 mm, ≥2.0 mm and ≤3.0 mm, ≥2.0 mm and ≤2.75 mm, ≥2.0 mm and ≤2.5 mm, or ≥2.0 mm and ≤2.25 mm.

In another aspect, the external rim 339 of the cap 206 can includes a rim thickness and the seal thickness 1510 can be at least about 50% of the rim thickness. For example, the seal thickness 1510 can be at least about 50% of the rim thickness, at least about 55% of the rim thickness, at least about 60% of the rim thickness, at least about 65% of the rim thickness, at least about 70% of the rim thickness, at least about 75% of the rim thickness, or at least about 80% of the rim thickness. In another aspect, the seal thickness 1510 can be limited. As such, the seal thickness 1510 may be not greater than about 200% of the rim thickness, not greater than about 175% of the rim thickness not greater than about 150% of the rim thickness, not greater than about 125% of the rim thickness, or not greater than about 100% of the rim thickness. The seal thickness 1510 can be in a range between and including any of the minimum or maximum thicknesses described above.

For example, the seal thickness 1510 can be ≥50% of the rim thickness and ≤200% of the rim thickness, such as ≥50% of the rim thickness and ≤175% of the rim thickness, ≥50% of the rim thickness and ≤150% of the rim thickness, ≥50% of the rim thickness and ≤125% of the rim thickness, or ≥50% of the rim thickness and ≤100% of the rim thickness. The seal thickness 1510 can be ≥55% of the rim thickness and ≤200% of the rim thickness, such as ≥55% of the rim thickness and ≤175% of the rim thickness, ≥55% of the rim thickness and ≤150% of the rim thickness, ≥55% of the rim thickness and ≤125% of the rim thickness, or ≥55% of the rim thickness and ≤100% of the rim thickness. Further, the seal thickness 1510 can be ≥60% of the rim thickness and ≤200% of the rim thickness, such as ≥60% of the rim thickness and ≤175% of the rim thickness, ≥60% of the rim thickness and ≤150% of the rim thickness, ≥60% of the rim thickness and ≤125% of the rim thickness, or ≥60% of the rim thickness and ≤100% of the rim thickness. Still further, the seal thickness 1510 can be ≥65% of the rim thickness and ≤200% of the rim thickness, such as ≥65% of the rim thickness and ≤175% of the rim thickness, ≥65% of the rim thickness and ≤150% of the rim thickness, ≥65% of the rim thickness and ≤125% of the rim thickness, or ≥65% of the rim thickness and ≤100% of the rim thickness.

Moreover, the seal thickness 1510 can be ≥70% of the rim thickness and ≤200% of the rim thickness, such as ≥70% of the rim thickness and ≤175% of the rim thickness, ≥70% of the rim thickness and ≤150% of the rim thickness, ≥70% of the rim thickness and ≤125% of the rim thickness, or ≥70% of the rim thickness and ≤100% of the rim thickness. The seal thickness 1510 can be ≥75% of the rim thickness and ≤200% of the rim thickness, such as ≥75% of the rim thickness and ≤175% of the rim thickness, ≥75% of the rim thickness and ≤150% of the rim thickness, ≥75% of the rim thickness and ≤125% of the rim thickness, or ≥75% of the rim thickness and ≤100% of the rim thickness. Additionally, the seal thickness 1510 can be ≥80% of the rim thickness and ≤200% of the rim thickness, such as ≥80% of the rim thickness and ≤175% of the rim thickness, ≥80% of the rim thickness and ≤150% of the rim thickness, ≥80% of the rim thickness and ≤125% of the rim thickness, or ≥80% of the rim thickness and ≤100% of the rim thickness.

In yet another aspect, the outer diameter 1506 of the seal 207 can be at least about 75% of the outer diameter of the external rim 339 of the cap 209. For example, the outer diameter 1506 can be at least about 80% of the outer diameter of the external rim, at least about 85% of the outer diameter of the external rim, at least about 90% of the outer diameter of the external rim, or at least about 95% of the outer diameter of the external rim. However, the outer diameter 1506 of the seal 207 may be no greater than about 120% of the outer diameter of the external rim, no greater than about 115% of the outer diameter of the external rim, no greater than about 110% of the outer diameter of the external rim, no greater than about 105% of the outer diameter of the external rim, or no greater than about 100% of the outer diameter of the external rim. The outer diameter 1506 of the seal 207 can be in a range between and including any of the minimum or maximum outer diameters described above.

For example, the outer diameter 1506 of the seal 207 can be ≥80% of the outer diameter of the external rim and ≤120% of the outer diameter of the external rim, such as ≥80% of the outer diameter of the external rim and ≤115% of the outer diameter of the external rim, ≥80% of the outer diameter of the external rim and ≤110% of the outer diameter of the external rim, ≥80% of the outer diameter of the external rim and ≤105% of the outer diameter of the external rim, or ≥80% of the outer diameter of the external rim and ≤100% of the outer diameter of the external rim. Further, the outer diameter 1506 of the seal 207 can be ≥85% of the outer diameter of the external rim and ≤120% of the outer diameter of the external rim, such as ≥85% of the outer diameter of the external rim and ≤115% of the outer diameter of the external rim, ≥85% of the outer diameter of the external rim and ≤110% of the outer diameter of the external rim, ≥85% of the outer diameter of the external rim and ≤105% of the outer diameter of the external rim, or ≥85% of the outer diameter of the external rim and ≤100% of the outer diameter of the external rim.

Moreover, the outer diameter 1506 of the seal 207 can be ≥90% of the outer diameter of the external rim and ≤120% of the outer diameter of the external rim, such as ≥90% of the outer diameter of the external rim and ≤115% of the outer diameter of the external rim, ≥90% of the outer diameter of the external rim and ≤110% of the outer diameter of the external rim, ≥90% of the outer diameter of the external rim and ≤105% of the outer diameter of the external rim, or ≥90% of the outer diameter of the external rim and ≤100% of the outer diameter of the external rim. The outer diameter 1506 of the seal 207 can be ≥95% of the outer diameter of the external rim and ≤120% of the outer diameter of the external rim, such as ≥95% of the outer diameter of the external rim and ≤115% of the outer diameter of the external rim, ≥95% of the outer diameter of the external rim and ≤110% of the outer diameter of the external rim, ≥95% of the outer diameter of the external rim and ≤105% of the outer diameter of the external rim, or ≥95% of the outer diameter of the external rim and ≤100% of the outer diameter of the external rim.

In another aspect, the inner diameter 1504 of the seal 207 can be approximately equal to, or slightly less, than the outer diameter of the distal end 334 of the cap 206. The seal 207 can be a single monolithic seal. In another aspect, the seal 207 can be a composite seal. For example, the seal 207 can be a multi-layered seal. Each layer of the seal 207 can comprise the same material or a different material. The seal 207 can be fixedly connected to the external rim 339 of the cap 206. For example, the seal 207 can be connected to the external rim 339 of the cap 206 by an adhesive. In another aspect, the seal 207 can be removably engaged with the cap.

Figure 17:
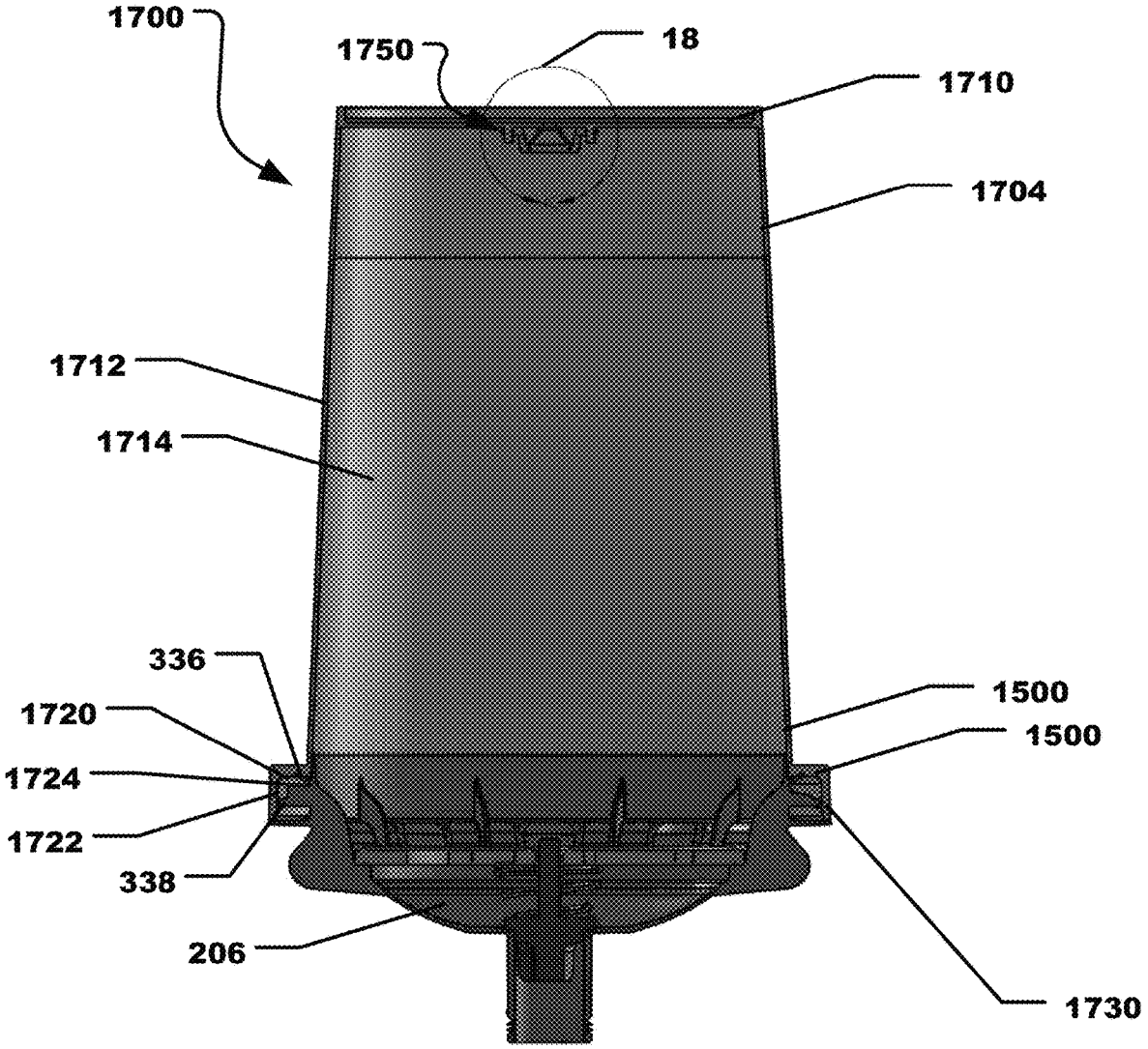
FIG. 17 includes a cross-sectional view of another embodiment of a paint cup assembly in accordance with a particular embodiment.

Referring now to FIG. 17, another embodiment of a paint cup assembly is illustrated and is designated 1700. As depicted, the paint cup assembly can include a cap 206 and a paint reservoir 1704 removably engaged therewith. In a particular aspect, the cap 206 is identical to the cap 206 shown and described above in conjunction with FIG. 2, FIG. 3, and FIG. 13.

The paint reservoir 1704 can include a generally flat, generally round, substantially rigid bottom 1710 (the paint cup assembly 1700 is illustrated in an upside down orientation in FIG. 17 to depict the manner in which the paint cup assembly 1700 would typically be used.)

As indicated in FIG. 17, a substantially rigid sidewall 1712 can extend from the rigid bottom 1710 to form an internal volume 1714 configured to receive paint. The sidewall 1712 can include a distal end 1716 formed with a hub 1718. The hub 1718 can be formed with threads (not illustrated) that are configured to threadably engage the external threads 334 formed on the cap 206, 1702. In fact, the configuration of the hub 1718 on the paint reservoir 1704 is substantially identical to the hub 312 formed on the external ring 204. As such, the paint reservoir 1704 can be interchangeable with the external ring 204/paint liner 202 on the paint cap 206, 1702 and a user would be able to choose whether to utilize a relatively rigid paint reservoir 1704 or a collapsible paint liner 202/external ring 204 assembly depending on the user's particular preferences and or the particular paint spraying operation to be performed by the user.

In a manner similar to the hub 312 formed on the external ring 204, but more clearly shown than in FIG. 13, the hub 1718 of the hub 1718 of the paint reservoir 1704 can include a primary seal engagement surface 1720 at the base of the hub 1718 and a secondary seal engagement surface 1722 formed on the inner wall of the hub 1718 adjacent to the primary seal engagement surface 1720. As illustrated, the secondary seal engagement surface 1722 is substantially perpendicular to the primary seal engagement surface 1720. When the paint reservoir 1704 is engaged with the cap 206, as depicted in FIG. 17, the primary sealing structure 336 can engage the primary seal engagement surface 1720 to establish a primary seal and the secondary sealing structure 338 can engage the secondary seal engagement surface 1722 to form a secondary seal.

Further, a paint containment pocket 1724 can be established, or otherwise formed, between the primary seal, the secondary seal, the primary seal surface 1720, and the secondary seal surface 1722. The paint containment pocket 1724 can capture and substantially contain any paint that breaches the primary seal formed between the primary sealing structure 336 and the primary seal engagement surface 1720. The seal 207, illustrated in FIG. 3, FIG. 15, and FIG. 16, can be installed between a distal end 1730 of the hub 1718 (aka, a cap engagement structure) and the external rim 339 of the cap 206. The seal 207 can establish a tertiary seal that can further contain any paint that leaks from the paint containment pocket 1724. In order to leak from the paint cup assembly, paint has to breach three different seals. Accordingly, the likelihood of paint leaking from the paint cup assembly is substantially reduced.

Figure 18:
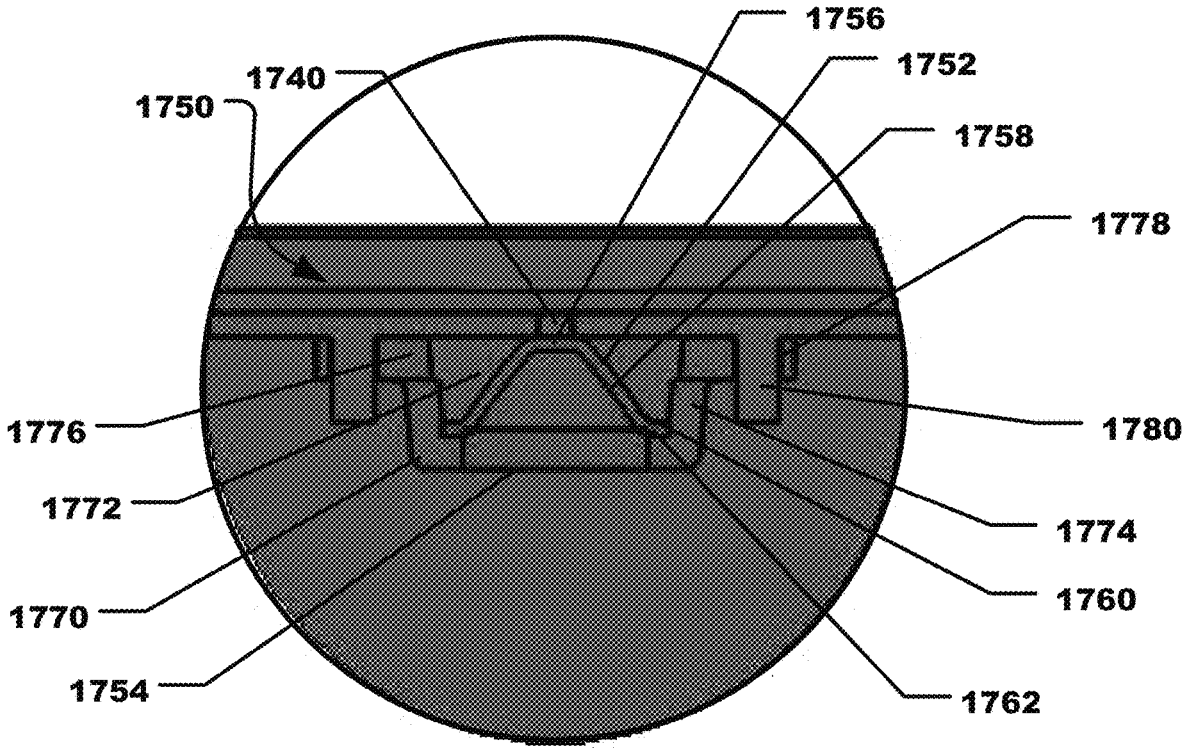
FIG. 18 includes a detailed cross-sectional view of the paint cup assembly in accordance with a particular embodiment taken at circle 18 in FIG. 17.

FIG. 17 and FIG. 18 further illustrate that the bottom 1710 of the paint reservoir 1704 can be formed with an air inlet port 1740. In a particular aspect, the air inlet port 1740 can be formed in a center of the bottom 1710 of the paint reservoir 1704.

A valve assembly 1750 can be installed, or otherwise disposed, on the bottom 1710 of the paint reservoir 1704 adjacent to the air inlet port 1740 so that the valve assembly 1750 is in fluid communication with the air inlet port 1740. The valve assembly 1750 can include a pressure actuated valve assembly. Further, the valve assembly 1750 can include a flexible bleeder 1752 and a bleeder retainer 1754. The flexible bleeder 1752 can be made from a flexible thermoplastic elastomer (TPE) and the bleeder retainer 1754 can be made from polypropylene (PP).

In a particular aspect, the elastic modulus of the TPE used to the construct the flexible bleeder 1752 can have an elastic modulus, $\lambda$, that can be ≥0.150 ksi, such as ≥0.20 ksi, ≥0.250 ksi, ≥0.30 ksi, or ≥0.350 ksi. Further, $\lambda$ can be ≤1.0 ksi, such as ≤0.80 ksi, ≤0.75 ksi, or ≤0.725 ksi. In a particular aspect, $\lambda$ can be within a range between and including any of the maximum and minimum values of $\lambda$ described herein.

For example, $\lambda$ can be ≥0.150 ksi and ≤1.0 ksi, such as ≥0.150 ksi and ≤0.80 ksi, ≥0.150 ksi and ≤0.75 ksi, or ≥0.150 ksi and ≤0.725 ksi. Further, $\lambda$ can be ≥0.20 ksi and ≤1.0 ksi, such as ≥0.20 ksi and ≤0.80 ksi, ≥0.20 ksi and ≤0.75 ksi, or ≥0.20 ksi and ≤0.725 ksi. In another aspect, $\lambda$ can be ≥0.250 ksi and ≤1.0 ksi, such as ≥0.250 ksi and ≤0.80 ksi, ≥0.250 ksi and ≤0.75 ksi, or ≥0.250 ksi and ≤0.725 ksi. Moreover, $\lambda$ can be ≥0.30 ksi and ≤1.0 ksi, such as ≥0.30 ksi and ≤0.80 ksi, ≥0.30 ksi and ≤0.75 ksi, or ≥0.30 ksi and ≤0.725 ksi. Still further, can be ≥0.350 ksi and ≤1.0 ksi, such as ≥0.350 ksi and ≤0.80 ksi, ≥0.350 ksi and ≤0.75 ksi, or ≥0.350 ksi and ≤0.725 ksi.

The flexible bleeder 1752 can be generally frustoconical and can include a flat base 1756. An angled wall 1758 can extend from the base 1756 and can include a distal end 1760. The distal end 1760 of the angled wall 1758 can be formed with a rim 1762. As illustrated in FIG. 17 and FIG. 18, the flat base 1756 of the flexible bleeder 1752 can abut and block the air inlet port 1740 formed in the paint reservoir 1704 when the bleeder 1752 is in the closed configuration illustrated in FIG. 17 and FIG. 18.

In a particular aspect, the angled wall 1758 of the bleeder 1752 can deform as the air pressure is reduced within the paint reservoir 1704. As the angled wall 1758 deforms the base 1756 of the flexible bleeder 1752 can moved away from the air inlet port 1740.

Accordingly, the flexible bleeder 1752 can move between a closed configuration in which the bleeder 1752 blocks the air inlet port 1740 and an open configuration in which the bleeder 1752 unblocks the air inlet port 1740. The bleeder 1752 is pressure actuated and can move to the open configuration as the air pressure inside the paint reservoir 1704 is reduced. For example, the air pressure can be reduced within the paint reservoir 1704 as paint is withdrawn from the paint reservoir 1704 during use of a spray gun attached thereto.

As indicated in FIG. 17, the bleeder retainer 1754 can be engaged with an interior surface of the bottom 1710 of the paint cup reservoir 1704. The bleeder retainer 1754 can surround the flexible bleeder 1752. The bleeder retainer 1754 can include a central hub 1770 that can include an interior 1772 in which the bleeder 1752 is installed or otherwise disposed. The central hub 1770 can also include at least one opening 1774 formed therein to let air pass through the central hub 1770 when the valve assembly 1750 is opened.

The bleeder retainer 1754 can also include a generally annular rim 1776 that can extend outwardly from the central hub 1770. The rim 1776 of the bleeder retainer 1754 can surround the air inlet port 1740 and abut the interior surface of the bottom 1710 of the paint reservoir 1704. The rim 1776 of the bleeder retainer 1754 can be formed with at least one engagement bore 1778 through the rim 1776. The paint reservoir 1704 can include at least one engagement post 1780 that can extend perpendicularly from the interior surface of the bottom 1710 of the paint reservoir 1704. The engagement bore 1778 of the rim 1776 can fit over the engagement post 1780 and maintain the bleeder retainer 1754 in engagement with the bottom 1710 of the paint reservoir 1704. In particular, the engagement bore engages the engagement post in an interference fit.

In a particular embodiment, the valve assembly 1750 can be operable to move between a closed configuration, in which air flow through the air inlet port 1740 is prevented, and an open configuration, in which air flow through the air inlet port 1740 is permitted, upon actuation of a spray gun coupled to the paint cup assembly 1700. The valve assembly 1750 can be pressure actuated and a change in pressure within the paint cup assembly 1700 can cause the valve assembly 1750 to move to the open configuration. The open configuration can be achieved automatically upon actuation of the spray gun.

In a particular aspect, the valve assembly 1750 can move to the open configuration at least partially based on the operating air pressure, $P_O$, of the spray gun, i.e., the pressure of pressurized air flowing through the spray gun. In a particular aspect, $P_O$ can be ≥10 psi, such as ≥15 psi, ≥20 psi, ≥25 psi, or ≥30 psi. Further, $P_O$ can be ≤50 psi, such as ≤45 psi, or ≤35 psi. Further, $P_O$ can be within a range between and including any of the minimum and maximum pressure values describe above.

For example, $P_O$ can be ≥10 psi and ≤50 psi, such as ≥10 psi and ≤45 psi, or ≥10 psi and ≤35 psi. $P_O$ can be ≥15 psi and ≤50 psi, such as ≥15 psi and ≤45 psi, or ≥15 psi and ≤35 psi. $P_O$ can be ≥20 psi and ≤50 psi, such as ≥20 psi and ≤45 psi, or ≥20 psi and ≤35 psi. Further, $P_O$ can be ≥25 psi and ≤50 psi, such as ≥25 psi and ≤45 psi, or ≥25 psi and ≤35 psi. Further still, $P_O$ can be ≥30 psi and ≤50 psi, such as ≥30 psi and ≤45 psi, or ≥30 psi and ≤35 psi.

In a particular aspect, the actuation pressure, $P_A$, to open the valve assembly 1750 can be $\leq P_O$. For example, the $P_A$ can be ≤5 psi, such as ≤4 psi, or ≤3 psi. Further, $P_A$ can be ≥1 psi, such as ≥1.5 psi, or ≥2 psi. Further, $P_A$ can be within a range between and including any of the minimum and maximum pressure values describe above.

For example, $P_A$ can be ≤5 psi and ≥1 psi, such as ≤5 psi and ≥1.5 psi, or ≤5 psi and ≥2 psi. $P_A$ can be ≤4 psi and ≥1 psi, such as ≤4 psi and ≥1.5 psi, or ≤4 psi and ≥2 psi. Moreover, $P_A$ can be ≤3 psi and ≥1 psi, such as ≤3 psi and ≥1.5 psi, or ≤3 psi and ≥2 psi.

It another aspect, the valve assembly 1750 can substantially prevent paint from leaking out of the air inlet port 1740 when the valve assembly 1750 is in the closed configuration and the paint cup assembly 1700 is standing substantially upright on the bottom 1710 of the paint reservoir 1704 (rotated 180° from the orientation illustrated in FIG. 17).

With the configuration described herein, the convertible paint cup assembly provides a paint cup assembly having a single cap onto which at least two different paint reservoirs can be threaded. The paint cup assembly can include a paint reservoir that includes a collapsible liner or a rigid paint reservoir. Moreover, the collapsible liner can be used with the extended ring or installed inside the rigid paint reservoir. Also, the extended ring can be configured to fit into the rigid paint reservoir so that the rigid paint reservoir can be used to support the extended ring and collapsible paint liner while being filled.

A user can select which type of paint reservoir to use based on the paint process or the user preferences. Further, the rigid paint reservoir includes an air inlet and a valve assembly. The valve assembly can automatically allow the infiltration of air into the rigid paint reservoir upon actuation of the paint sprayer.

Note that not all of the activities described above in the general description or the examples are required, that a portion of a specific activity may not be required, and that one or more further activities may be performed in addition to those described. Still further, the order in which activities are listed is not necessarily the order in which they are performed.

Certain features that are, for clarity, described herein in the context of separate embodiments, may also be provided in combination in a single embodiment. Conversely, various features that are, for brevity, described in the context of a single embodiment, may also be provided separately or in any subcombination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A paint cup assembly for a paint sprayer, comprising:

a cap;

a paint reservoir having an air inlet port in direct fluid communication with an ambient environment, wherein the paint reservoir has a first end and a second end opposite the first end, wherein the first end is adjacent the cap, and wherein the air inlet port is defined by the second end of the paint reservoir; and a valve assembly, wherein at least a portion of the valve assembly is disposed between the air inlet port and an internal volume of the paint reservoir such that the valve assembly is in fluid communication with the paint reservoir and engaged with the air inlet port, wherein the valve assembly is configured to be operable from a closed configuration, in which air flow through the air inlet port is prevented, and an open configuration, in which air flow through the air inlet port is permitted from the ambient environment, during actuation of the paint sprayer, wherein the valve assembly comprises a flexible bleeder adjacent to the air inlet port, and wherein the flexible bleeder is configured to move between a closed configuration in which the flexible bleeder blocks the air inlet port and an open configuration in which the flexible bleeder unblocks the inlet port, and wherein the entirety of the flexible bleeder is located inside the paint reservoir.

2. The paint cup assembly of claim 1, wherein the open configuration is achieved automatically upon actuation of the spray gun.

3. The paint cup assembly of claim 1, wherein the valve assembly is configured to move to the open configuration at least partially based on pressurized air flowing through the spray gun.

4. The paint cup assembly of claim 1, wherein the flexible bleeder is configured to move to the open configuration as the air pressure inside the paint reservoir is reduced.

5. The paint cup assembly of claim 1, wherein the air inlet port is formed in a bottom of the paint reservoir and wherein the valve assembly is affixed to the bottom of the paint reservoir adjacent to the air inlet port.

6. A paint cup assembly for a paint sprayer, comprising:

a cap having an outlet;

a paint reservoir having an air inlet port in direct fluid communication with an ambient environment, the paint reservoir configured to engage the cap, wherein the paint reservoir has a first end and a second end opposite the first end, wherein the first end is adjacent the cap, and wherein the inlet port is defined by the second end of the paint reservoir;

a first valve assembly in fluid communication with the cap, wherein the first valve assembly is configured to control paint flow through the outlet; and a second valve assembly in fluid communication with the paint reservoir, wherein the second valve assembly is configured to permit air flow through the inlet port from the ambient environment during actuation of the paint sprayer, wherein at least a portion of at least the second valve assembly is disposed between the air inlet port and an internal volume of the paint reservoir, wherein the second valve assembly comprises a flexible bleeder adjacent to the air inlet port, and wherein the flexible bleeder is configured to move between a closed configuration in which the flexible bleeder blocks the air inlet port and an open configuration in which the flexible bleeder unblocks the inlet port, and wherein the entirety of the flexible bleeder is located inside the paint reservoir.

7. The paint cup assembly of claim 6, wherein the first valve assembly is configured to be operable from a closed configuration in which fluid flow through the outlet is prevented to an open configuration in which fluid flow through the outlet is permitted upon engagement with a paint sprayer.

8. The paint cup assembly of claim 6, wherein the second valve assembly is configured to be operable from a closed configuration in which air flow through the air inlet port is prevented and an open configuration in which air flow through the air inlet port is permitted upon actuation of a spray gun.

9. The paint cup assembly of claim 8, wherein the open configuration is achieved automatically upon actuation of the spray gun.

10. The paint cup assembly of claim 6, wherein the first valve comprises a plunger and a spring, and wherein the first valve is disposed between the outlet and a valve retainer.

11. The paint cup assembly of claim 6, wherein the air inlet port is formed in a bottom of the paint reservoir and wherein the second valve assembly is affixed to the bottom of the paint reservoir adjacent to the air inlet port.

12. The paint cup assembly of claim 6, wherein the paint reservoir comprises a substantially rigid sidewall extending from a substantially rigid bottom.

13. The paint cup assembly of claim 6, wherein the flexible bleeder has a generally frustoconical sidewall extending from a flat base.

14. A paint cup assembly for a paint sprayer, comprising:

a paint reservoir comprising:

a bottom;

a sidewall extending from the bottom; and an air inlet port defined by and disposed along the bottom and in direct fluid communication with an ambient environment, wherein the paint reservoir is adapted to hold paint; and a valve assembly, wherein at least a portion of the valve assembly is disposed between the air inlet port and an internal volume of the paint reservoir such that the valve assembly is in fluid communication with the paint reservoir, wherein the valve assembly is configured to permit air flow from the ambient environment through the inlet port into the paint reservoir during removal of paint from the paint reservoir, wherein the valve assembly comprises a flexible bleeder adjacent to the air inlet port, and wherein the flexible bleeder is configured to move between a closed configuration in which the flexible bleeder blocks the air inlet port and an open configuration in which the flexible bleeder unblocks the inlet port, and wherein the entirety of the flexible bleeder is located inside the paint reservoir.

15. The paint cup assembly of claim 14, wherein the bottom and sidewall are substantially rigid.

16. The paint cup assembly of claim 14, wherein the flexible bleeder has a generally frustoconical sidewall extending from a flat base.

17. The paint cup assembly of claim 14, wherein the valve assembly is disposed on an interior surface of the bottom of the paint reservoir.

* * * * *